US006730100B2

(12) United States Patent
Yamaguchi et al.

(10) Patent No.: US 6,730,100 B2
(45) Date of Patent: May 4, 2004

(54) DEPILATING DEVICE

(75) Inventors: Naoki Yamaguchi, Hikone (JP); Toshihiro Takeuchi, Hikone (JP); Kenichi Muraki, Hikone (JP)

(73) Assignee: Matsushita Electric Works, Ltd., Kadoma (JP)

( * ) Notice: Subject to any disclaimer, the term of this patent is extended or adjusted under 35 U.S.C. 154(b) by 94 days.

(21) Appl. No.: 09/993,658

(22) Filed: Nov. 27, 2001

(65) Prior Publication Data

US 2002/0065522 A1 May 30, 2002

(30) Foreign Application Priority Data

Nov. 27, 2000 (JP) ..... 2000-360243

(51) Int. Cl.[7] ..... A61B 17/50
(52) U.S. Cl. ..... 606/133
(58) Field of Search ..... 606/133, 131, 606/184, 185, 186, 187

(56) References Cited

U.S. PATENT DOCUMENTS 4,079,741 A 3/1978 Daar et al.
5,133,722 A 7/1992 Avrahami et al.
5,797,925 A 8/1998 Heintke
6,436,106 B2 * 8/2002 Yiu ..... 606/133

FOREIGN PATENT DOCUMENTS

| | | |
|---|---|---|
| EP | 0 950 365 A1 | 10/1999 |
| JP | 2000-125922 | 5/2000 |
| JP | 2000-125925 | 5/2000 |
| WO | WO 99/19984 | 9/1994 |

* cited by examiner

*Primary Examiner*—Kevin T. Truong
(74) *Attorney, Agent, or Firm*—Oblon, Spivak, McClelland, Maier & Neustadt, P.C.

(57) ABSTRACT

A depilating device including a housing, a depilation head detachably attached to the housing and including a hair removing device configured to remove hairs, a driving unit provided in the housing and configured to drive the hair removing device, and at least one overload clutch provided in the housing to transmit driving output by the driving unit to the hair removing device and configured to interrupt transmission of the driving when a torque required to operate the hair removing device is beyond a predetermined value.

20 Claims, 25 Drawing Sheets

DEPILATING DEVICE

CROSS-REFERENCE TO RELATED APPLICATIONS

The present application claims priority under 35 U.S.C. §119 to Japanese Patent Application No. 2000-360243, filed Nov. 27, 2000, entitled Depilating Device. The contents of that application are incorporated herein by reference in their entirety.

BACKGROUND OF THE INVENTION

1. Field of the Invention

The present invention relates to a depilating device for removing hairs.

2. Description of the Background

Japanese Unexamined Patent Publication (Kokai) No. 2000-125925, which is incorporated herein by reference, discloses a depilating device which is equipped with a rotating cylinder. The rotating cylinder has a pair of claws that opens and closes with rotation of the rotating cylinder. The claws pinch and pull out hairs from skin as the rotating cylinder rotates. A housing contains a driving unit which drives the rotating cylinder. A head equipped with the rotating cylinder for depilation may be freely attached to the housing.

In this depilating device, an overload clutch which controls rotation of the rotating cylinder when the rotating cylinder is overloaded is built in the head. Since the head must accommodate a space for the overload clutch, the head becomes large.

SUMMARY OF THE INVENTION

According to one aspect of the present invention, a depilating device includes a housing, a depilation head detachably attached to the housing and including a hair removing device configured to remove hairs, a driving unit provided in the housing and configured to drive the hair removing device, and at least one overload clutch provided in the housing to to transmit driving output by the driving unit to the hair removing device and configured to interrupt transmission of the driving when a torque required to operate the hair removing device is beyond a predetermined value.

According to another aspect of the present invention, a depilating device includes a housing, a plurality of depilation heads each configured to attach to the housing and each including a hair removing device configured to remove hairs, the plurality of depilation heads being selectively attached to the housing according to hairs to be removed, a driving unit provided in the housing between the hair removing device and the driving unit and configured to drive the hair removing device, and at least one overload clutch provided in the housing to transmit driving output by the driving unit to the hair removing device and configured to interrupt transmission of the driving when a torque required to operate the hair removing device is beyond a predetermined value.

BRIEF DESCRIPTION OF THE DRAWINGS

A more complete appreciation of the invention and many of the attendant advantages thereof will become readily apparent with reference to the following detailed description, particularly when considered in conjunction with the accompanying drawings, in which:

FIG. 24(*b*) is a disassembled perspective diagram of the overload clutch according to another embodiment of the present invention;

DESCRIPTION OF THE EMBODIMENTS

Figure 1:
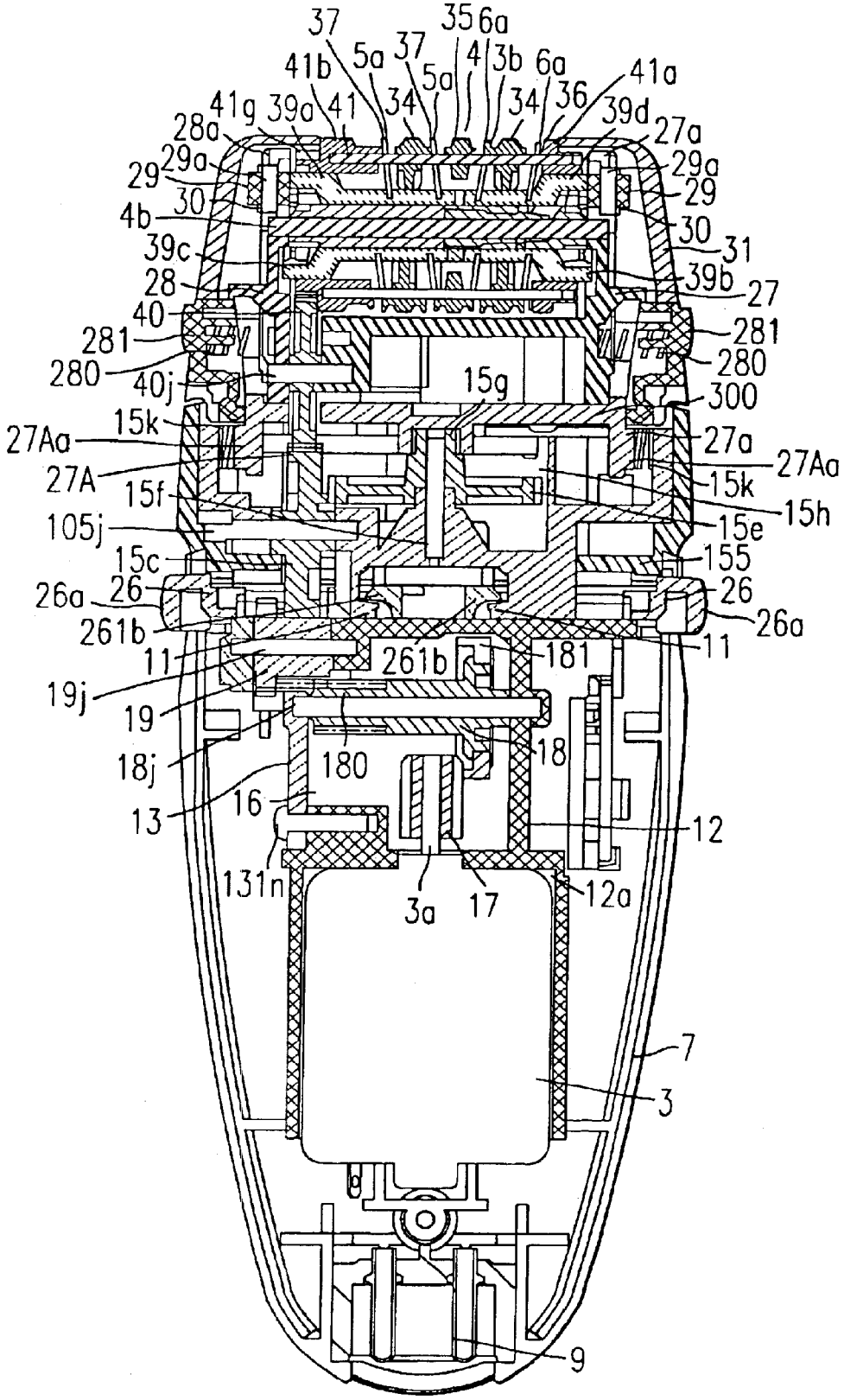
FIG. 1 is a longitudinal section of a depilating device according to a first embodiment of the present invention.
Figure 2:
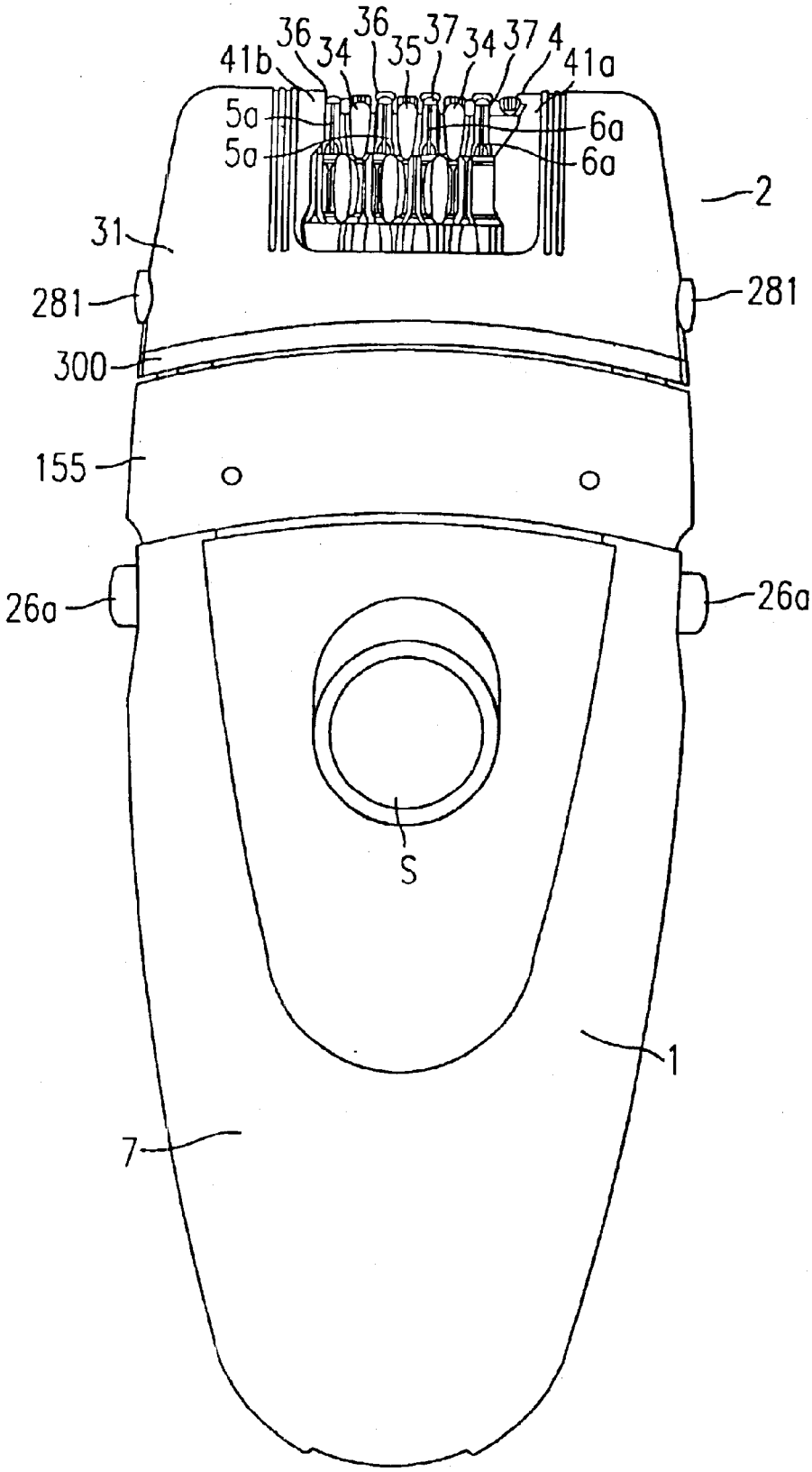
FIG. 2 is a front view of the depilating device according to the first embodiment of the present invention.
Figure 3:
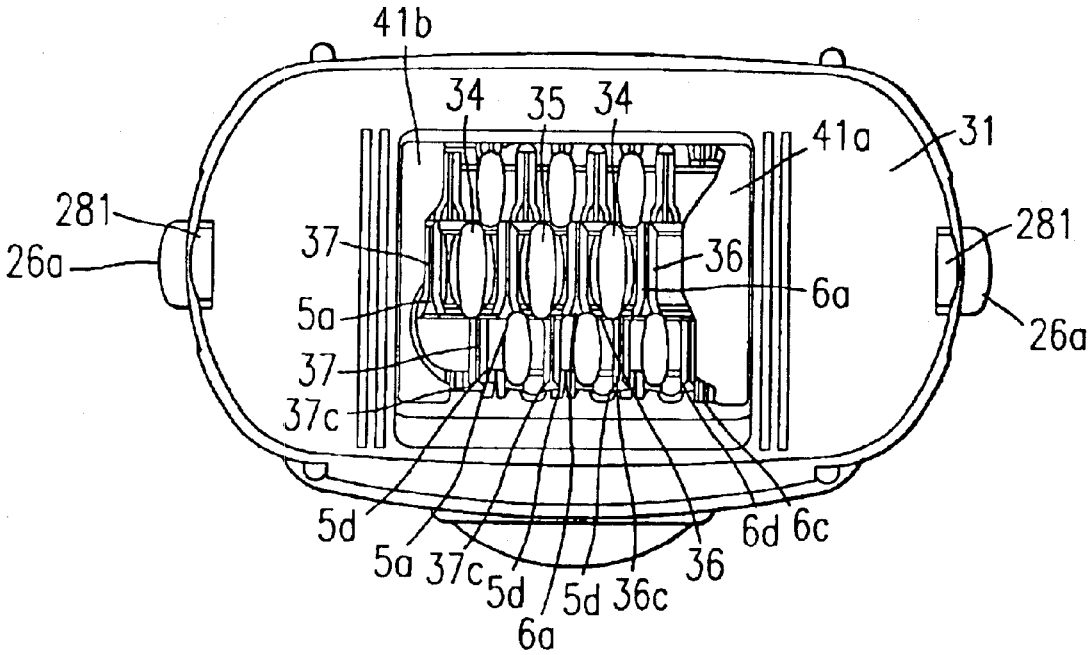
FIG. 3 is a plane view of the depilating device according to the first embodiment of the present invention.
Figure 4:
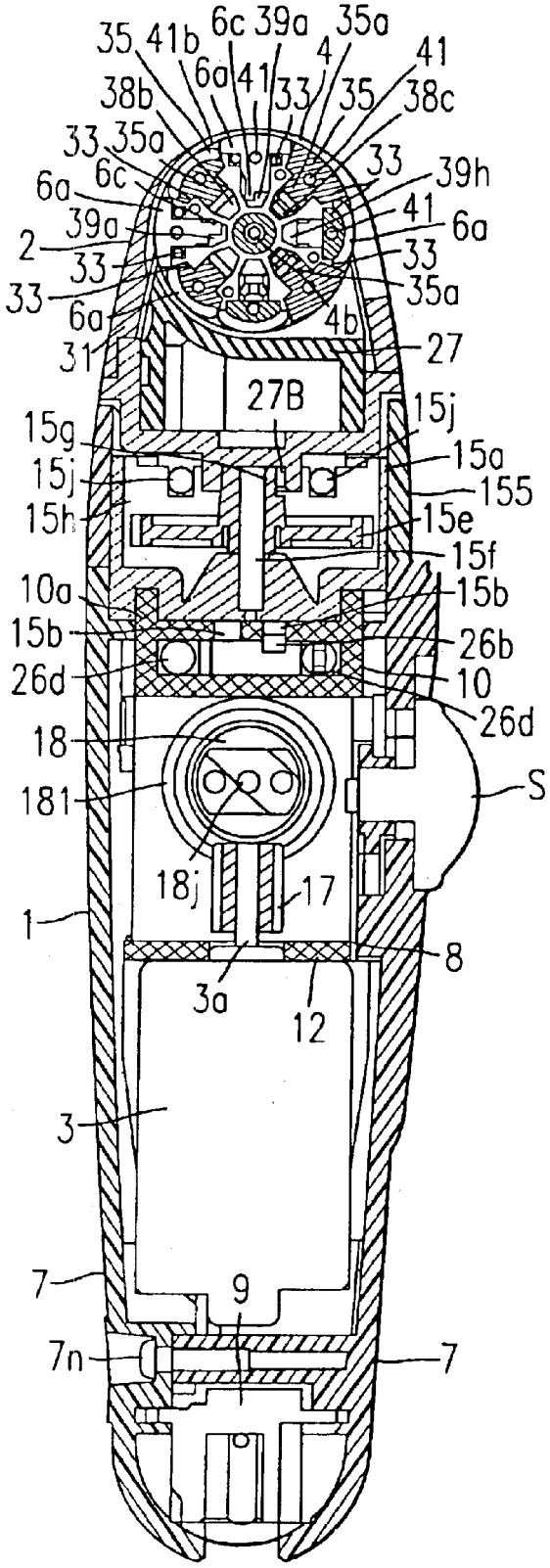
FIG. 4 is a cross-sectional view of the depilating device according to the first embodiment of the present invention.
Figure 5:
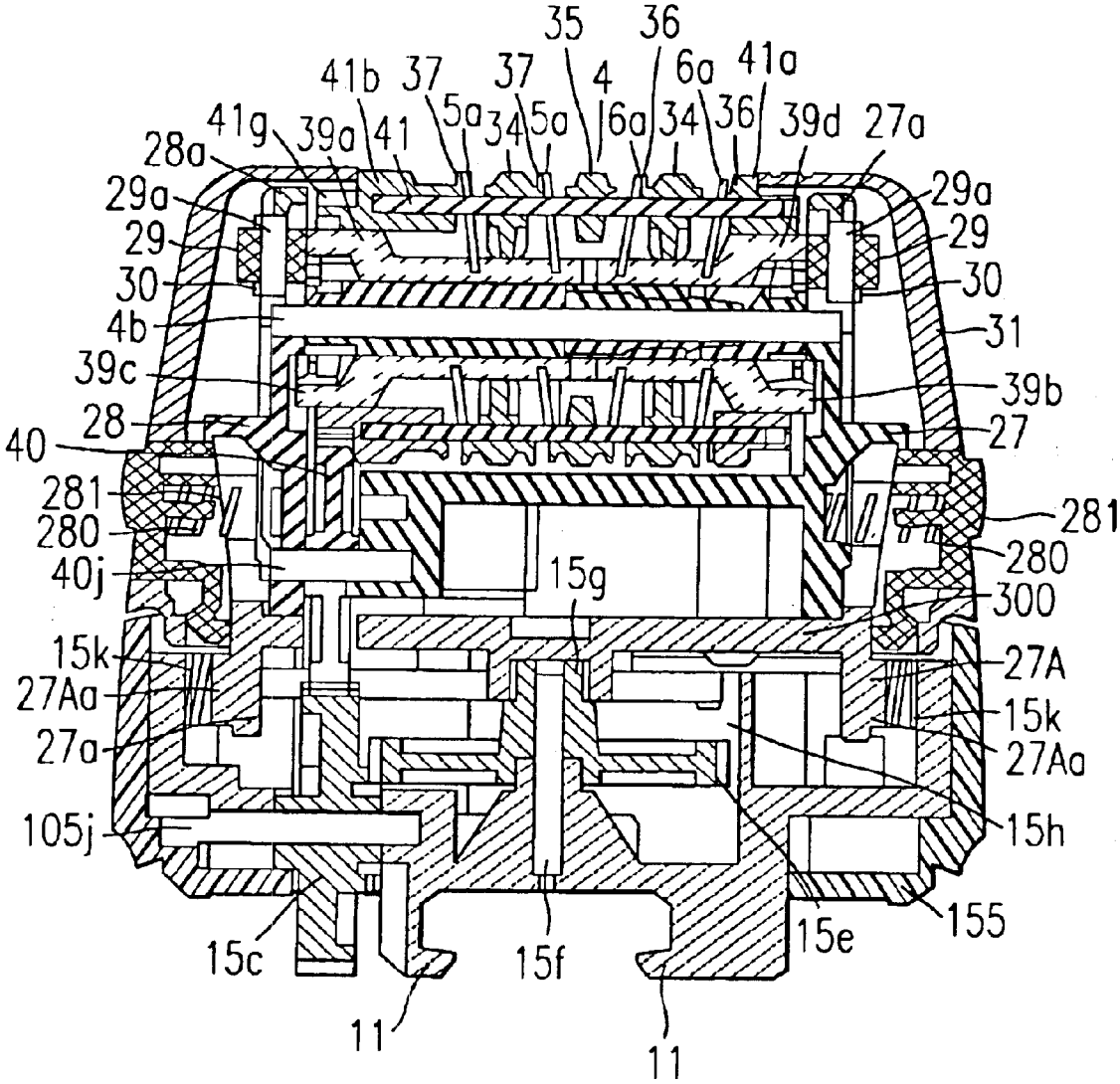
FIG. 5 is a longitudinal section of a head according to the first embodiment of the present invention.

The embodiments will now be described with reference to the accompanying drawings, wherein like reference numerals designate corresponding or identical elements throughout the various drawings.

FIG. 1 is a longitudinal section of a depilating device according to a first embodiment of the present invention. A depilating device is formed, for example, in the size that can be grasped in a hand and has a housing 1 having a motor 3 as a driving unit. A depilation head 2 equipped with a rotating cylinder 4 is attached on the housing 1. A depilation section includes two or more claws (5*a*, 6*a*, 36, 37) that open and close as the rotating cylinder 4 rotates. The depilation section thus pinches and pulls out hairs from skin with rotation of the rotating cylinder 4.

Figure 7:
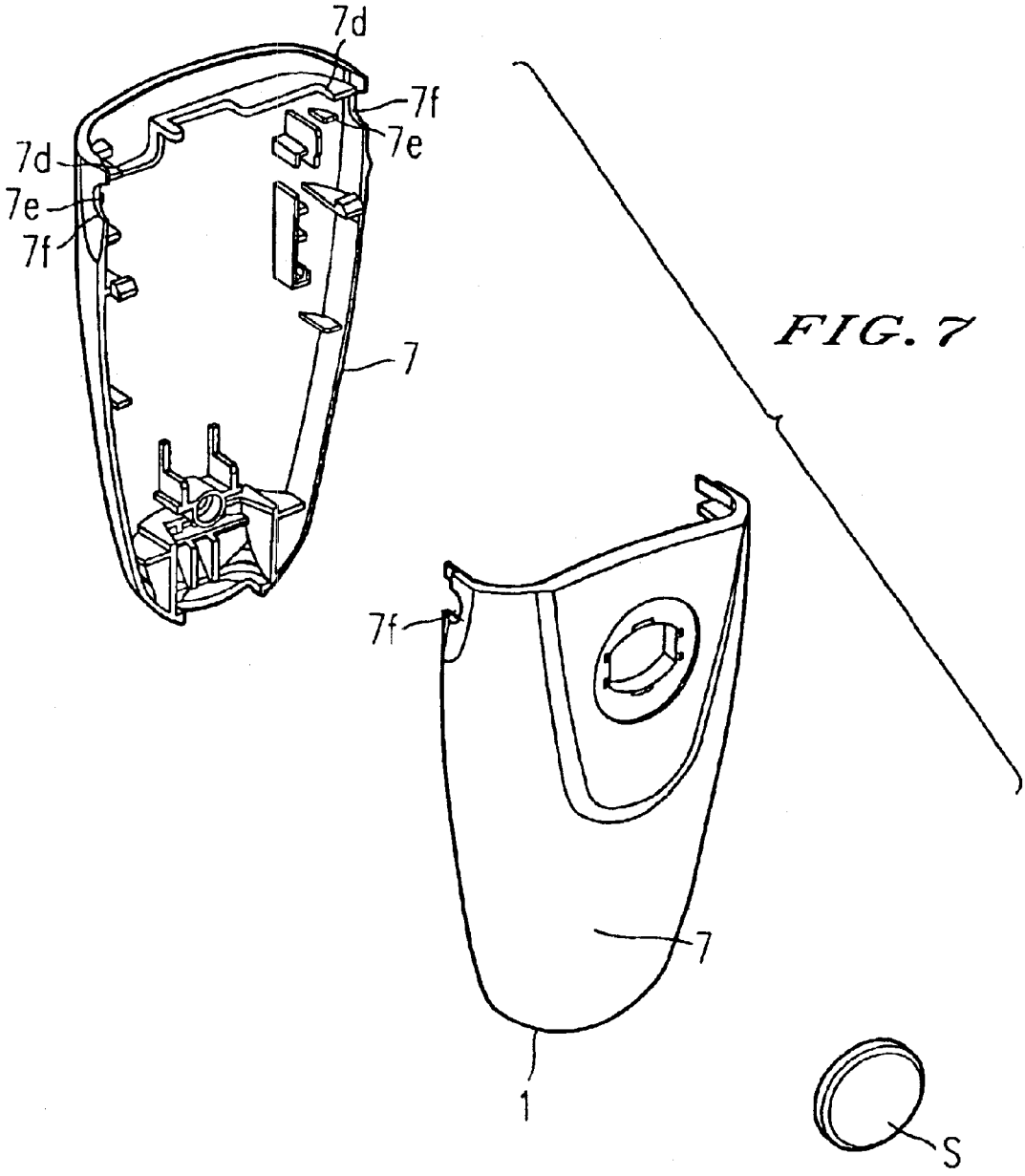
FIG. 7 is a disassembled perspective diagram of a housing to the first embodiment of the present invention.
Figure 8:
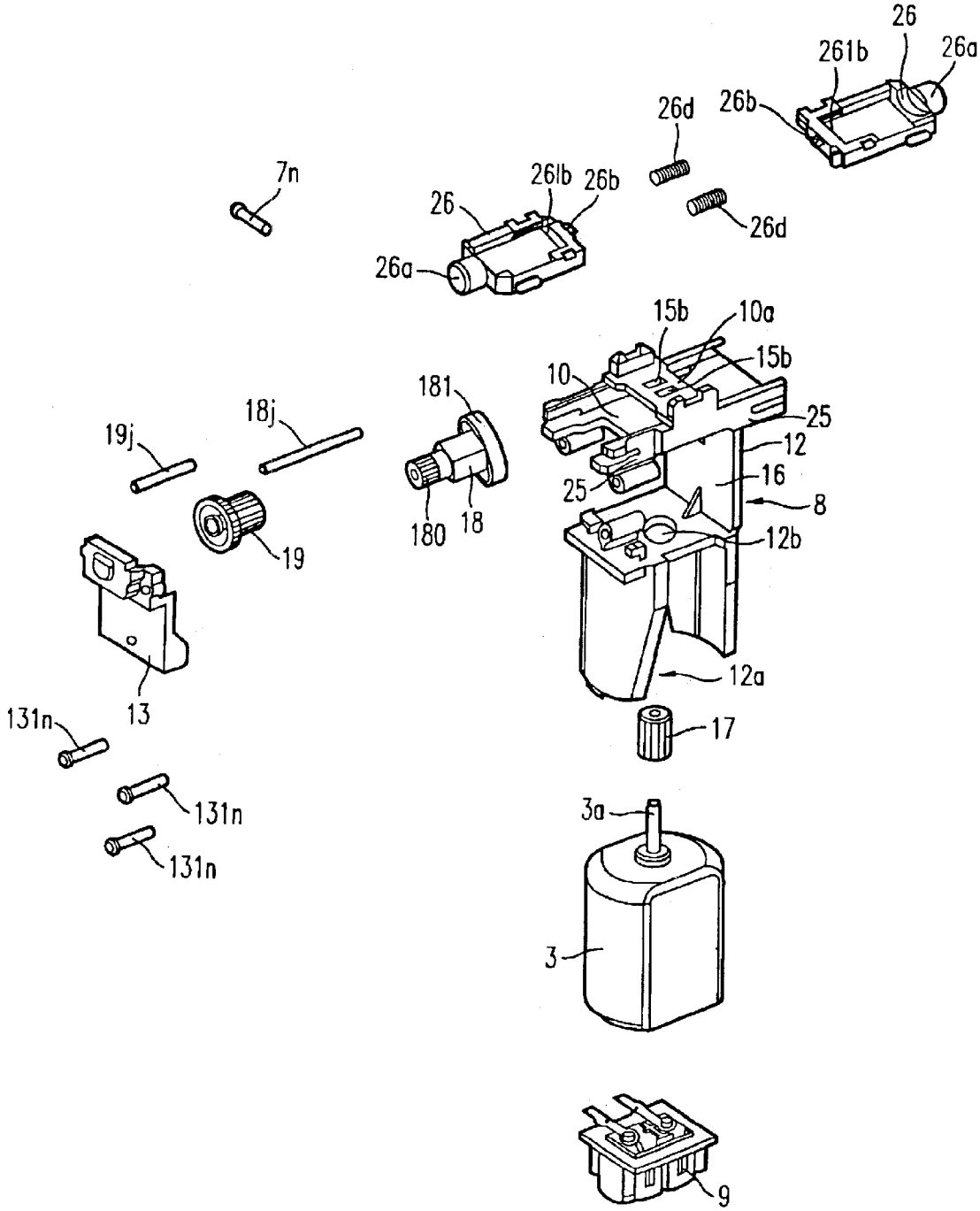
FIG. 8 is a disassembled perspective diagram of the components in the housing to the first embodiment of the present invention.

Referring to FIGS. 7 and 8, the housing 1 comprised of two half housings 7, 7 joined by screw 7*n*, and has a switch (S) in its front face. The motor 3 and a drive transmission section are provided in a base 8. The base 8 is provided in the housing 1, and a top-face section of the base 8 partitions an upper part of the housing 1. A plug 9 for electric supply is provided in a bottom of the housing 1. Alternatively, a battery may be accommodated in the housing 1 for a power source.

The top face of the base 8 has a hook connection 10. The base 8 has a base portion 12 for accommodating the motor 3, and a cover 13 fixed to a side opening of the base portion 12 by screws (131*n*). An interior section (12*a*) is provided in a lower part of the base portion 12. The motor 3 is inserted in the interior section (12*a*) from the lower part of the interior section (12*a*). An overload clutch 18 and a reduction gear 19 are provided in a space 16 provided in an upper part of the base portion 12. The base portion 12 is fixed inside the housing 1 by fitting a support frame 25 between projections (7*e*, 7*e*).

Figure 13:
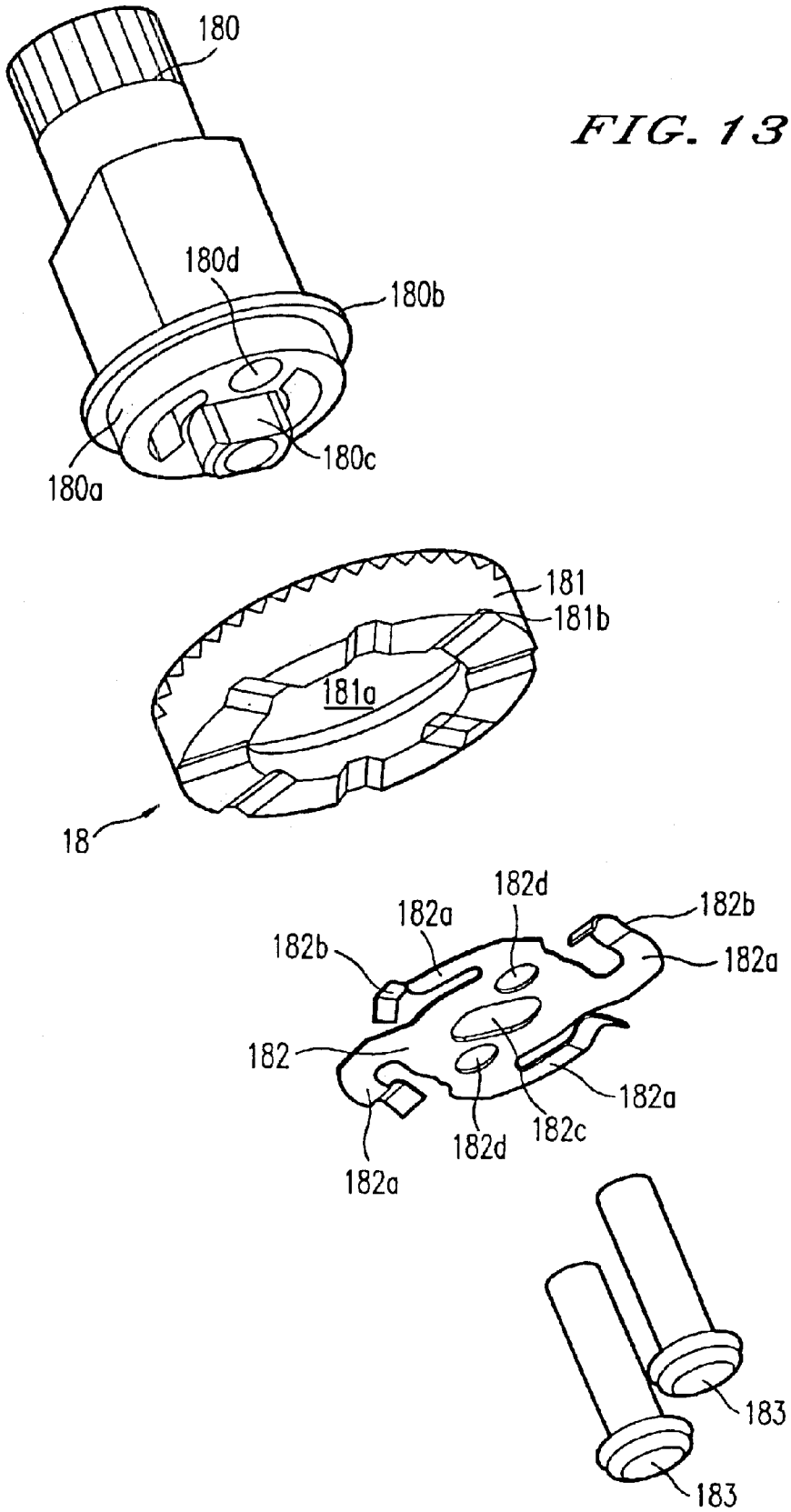
FIG. 13 is a disassembled perspective diagram of an overload clutch according to the first embodiment of the present invention.

Referring to FIG. 13, the overload clutch 18 includes a face gear 181, a pinion 180, and a clutch spring 182. The overload clutch 18 is fixed to the base 8 with a shaft (18*j*). The pinion 180 includes an insertion section (180*a*), a collar section (180*b*), a positioning projection (180*c*), and a hole (180*d*) for a screw at the end face of the insertion section (180*a*). The face gear 181 includes a hole (181*a*) in which the insertion section (180*a*) of the pinion 180 is inserted such that the pinion 180 rotates freely. Two or more slot type stop sections (181*b*) are formed in the perimeter of the hole (181*a*).

The clutch spring 182 is a flat spring having spring arms (182*a*) formed in the perimeter of the clutch spring 182. The spring arms (182*a*) are jutted out to a counter-rotational direction. The clutch spring 182 also includes a positioning hole (182*c*), and screw holes (182*d*) in its center section. Each spring arm (182*a*) has a projection (182*b*) at its end.

The insertion section (180*a*) of the pinion 180 is inserted in the hole (181*a*) provided in the face gear 181 such that the pinion 180 rotates freely. The collar section (180*b*) provided in the pinion 180 makes contact with the outside of the face gear 181. The positioning projection (180*c*) is inserted in the hole (182*c*) for positioning of the flat spring 182. Screws 183 are inserted through the holes (182*d*), respectively, and bolted in the holes (180*d*) of the pinion 180. Thus, the clutch spring 182 is attached to the pinion 180. The projections (182*b*) of the clutch spring 182 are elastically latched to the stop sections (181*b*). Thereby, the rotation transmitted to the face gear 181 is further transmitted to the pinion 180 through the clutch spring 182. When the power beyond a predetermined torque is transmitted to the overload clutch 18, the projections (182*b*) provided in the clutch spring 182 disengage from the stop sections (181*b*), and the face gear 181 runs idle to the pinion 180. Since the overload clutch 18 interrupts the torque generated by the motor 3 when body hairs or some other things are stuck in the rotating cylinder 4, causing the rotating cylinder 4 to lock, the damage on the drive transmission section can be prevented. In addition, rather than a mechanical overload clutch such as one described above, an electromagnetic clutch which detect an electrical load, for example, a current, on a motor may be used.

Referring to FIG. 8, an output shaft (3*a*) of the motor 3 is positioned in the space 16 through the hole (12*b*) of the base portion 12. A pinion 17 is fixed to the output shaft (3*a*) in the space 16. The pinion 17 meshes with the face gear 181. The reduction gear 19 supported by a shaft (19*j*) is exposed in the top face of the base 8 and meshes with the pinion 180. Therefore, the rotation of the motor 3 is transmitted to the reduction gear 19 through the pinion 17 and the overload clutch 18. Subsequently, the reduction gear 19 drives the rotating cylinder 4 of the depilation head 2.

The hook connection 10 has the projection (10*a*) forming a tunnel configuration in the center of the top face of the base portion 12, and is configured to accommodate a couple of slide frames 26, 26. The top face of the projection (10*a*) has holes (15*b*, 15*b*).

Each slide frame 26 is substantially rectangle and has a controlling element (26*a*). Each of slide frames 26, 26 also has a support hook (261*b*). The slide frames 26, 26 each have a projection (26*b*). The slide frames 26, 26 are slidably engaged in the tunnel configuration of the projection (10*a*) as the projections (26*b*, 26*b*) are inserted in the holes (15*b*, 15*b*), respectively, such that the projections (26*b*, 26*b*) are slidably engaged in the holes (15*b*, 15*b*). The slide frames 26, 26 abut against the projections (26*b*, 26*b*) and the edge of the hole (15*b*). Springs (26*d*, 26*d*) are provided in the tunnel passage and urge the slide frames 26, 26 away from each other. The controlling elements (26*a*, 26*a*) of the slide frames 26, 26 project outside of the housing 1 through holes (7*f*) provided in the housing 1.

Figure 9:
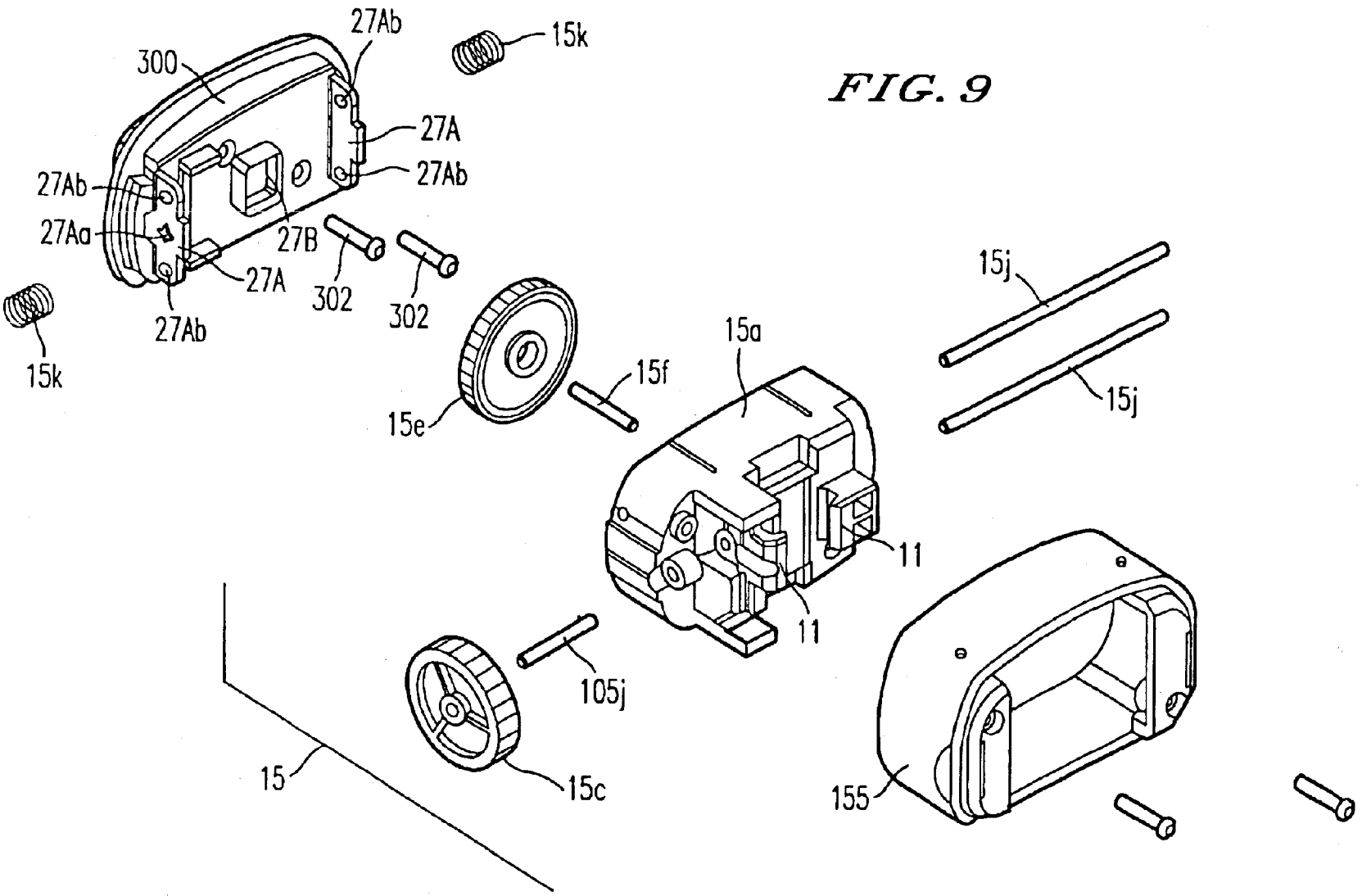
FIG. 9 is a disassembled perspective diagram of a base block and a base to the first embodiment of the present invention.
Figure 10:
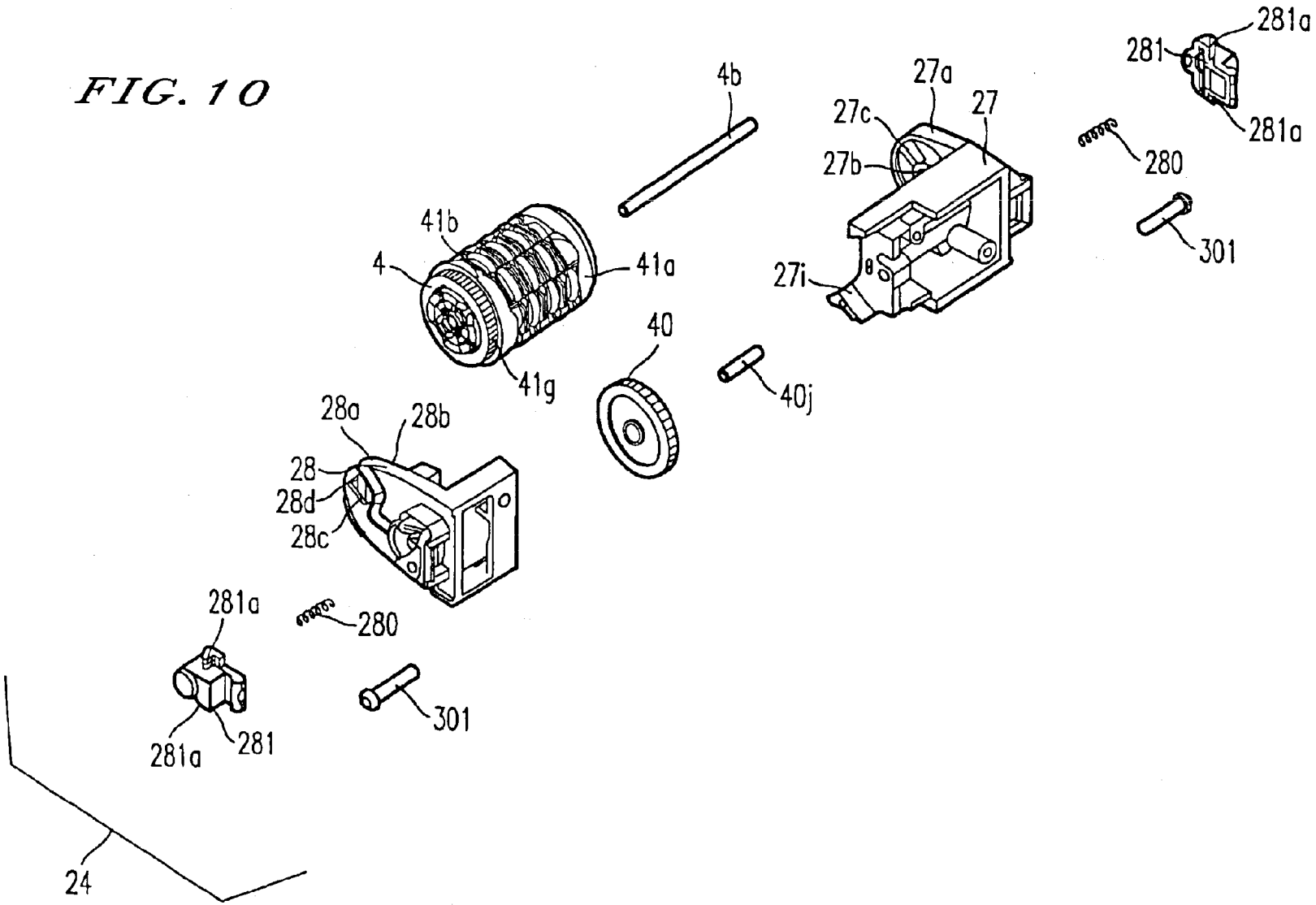
FIG. 10 is a disassembled perspective diagram of a depilation block according to a first embodiment of the present invention.
Figure 11:
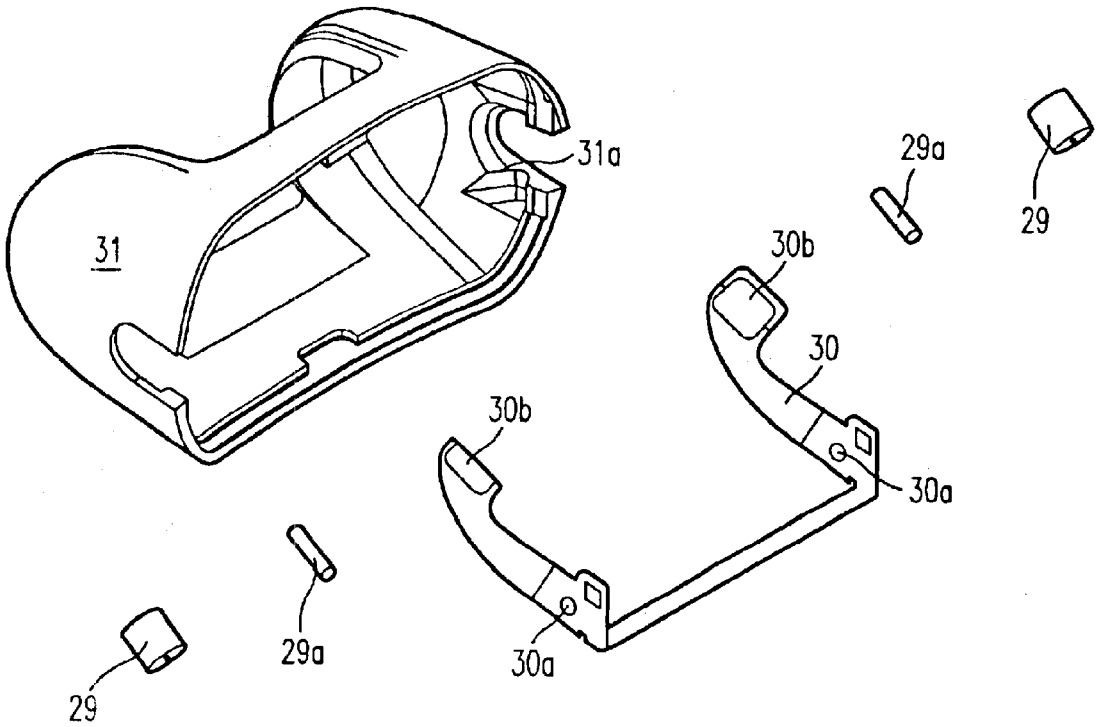
FIG. 11 is a disassembled perspective diagram of other components of the depilation block according to a first embodiment of the present invention.

Referring to FIGS. 9, 10 and 11, a depilation head has a base block 15 and a depilation block 24. The depilation block 24 includes the rotating cylinder 4 equipped with a depilation section, a cylinder mount 27 which supports the rotating cylinder 4, a cylinder cover 28, cams 29, 29, a maintenance spring 30, a head frame 31, and a base 300.

The rotating cylinder 4 is mounted to the cylinder mount 27. The cylinder mount 27 and the cylinder cover 28 have support sections (27*a*, 28*a*) projecting from their upper parts. The both ends of a shaft (4*b*) inserted in the rotating cylinder 4 are supported by holes (27*b*, 28*b*) provided in the support sections (27*a*, 28*a*) such that the rotating cylinder 4 rotates with respect to the shaft (4*b*). The support sections (27*a*, 28*a*) have cam insertion holes (27*c*, 28*c*) and axial support slots (27*d*, 28*d*) located in the vertical edge of the cam insertion holes (27*c*, 28*c*). Roller type cams 29 are inserted in the cam insertion holes (27*c*, 28*c*). The both ends of the roller shafts (29*a*, 29*a*) inserted in each cam 29, 29 are inserted in the axial support slots (27*d*, 28*d*). The cams 29 are supported such that they rotate freely in the level state and that the cams 29 project partly toward inside from the cam insertion holes (27*c*, 28*c*).

The maintenance spring 30 is attached outside of the support sections (27*a*, 28*a*), each fixed to the cylinder mount 27 and cylinder cover 28 with screws 301, 301 inserted in holes (30*a*, 30*a*). An upper part of the maintenance spring 30 has holes (30*b*, 30*b*). The ends of the roller shaft (29*a*) are elastically held by the edge of upper and lower sides of the hole (30*b*), and the hole (30*b*) is formed sufficiently large such that the cams 29 themselves do not touch the maintenance spring 30.

The cylinder mount 27 is mounted on the top face of the base 300 with screws 302, 302. The external end surfaces of the cylinder mount 27 and the cylinder cover 28 each have a button 281 which is urged toward by a spring 280. The button 281 has a hook (281*a*) for detaching from and attaching to the head frame 31. If the buttons 281, 281 are pushed in, the hooks (281*a*, 281*a*) release hook receptacles (31*a*, 31*a*) of the head frame 31, and the head frame 31 is disengaged from the depilation block 24.

In FIG. 10, a driving gear 40 is arranged in the concavity (27*i*) formed in the cylinder mount 27. A shaft (40*j*) supported by the cylinder mount 27 and the cylinder cover 28 holds the driving gear 40. The driving gear 40 meshes with a reduction gear (41*g*) provided to the rotating cylinder 4. The driving gear 40 also meshes with a reduction gear (15*c*) provided to the base block 15 show in FIG. 12.

Figure 12:
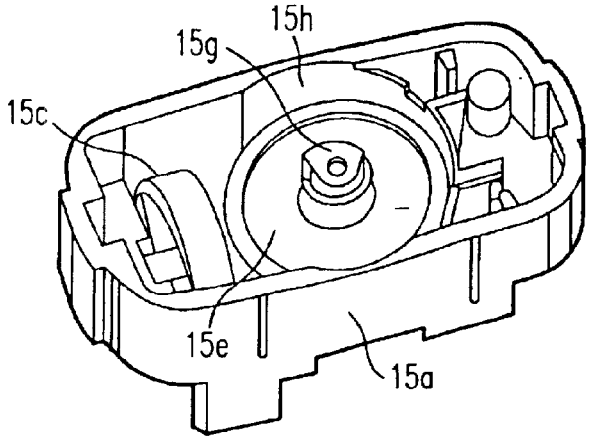
FIG. 12 is a perspective diagram of the base block according to the first embodiment of the present invention.

Referring to FIGS. 9 and 12, the base block 15 includes a base body (15*a*), a base block cover 155 surrounding the periphery of the base body (15*a*), an upper concavity (15*h*) of the base body (15*a*), the reduction gear (15*c*) provided in the upper concavity (15*h*), and a gear (15*e*). As shown in FIG. 9, the gear (15*e*) supported by a shaft (15*f*) meshes with the reduction gear (15*c*) supported by a horizontal shaft (105*j*). The gear (15*e*) also has a deflection cam (15*g*) as shown in FIG. 12.

The depilation block 24 is arranged on the base block 2. In FIG. 9, a rib (27A) is provided in the base 300 and is position its fit with in being the upper concavity (15*h*). Slide guide shafts (15*j*, 15*j*) penetrate the base body (15*a*) by being inserted in holes (27Ab, 27Ab(s)) provided in the ribs (27A, 27A), and the base 300 is arranged so that the base 300 is capable of sliding along the slide guide shafts (15*j*). Accordingly, the depilation block 24 slides along the slide guide shafts (15*j*).

Springs (15*k*, 15*k*) are arranged between spring receptacles (27Aa, 27Aa(s)) and the concavity (15*h*). For this reason, the depilation block 24 can slide along the base block 15 at the shaft of the rotating cylinder 4. The depilation block 24 is located in the center of the base block 15 with both springs (15*k*, 15*k*).

The deflection cam (15*g*) in FIG. 12 engages with a concavity (27B) in FIG. 9. When the deflection cam (15*g*) rotates, it pushes the inside of the concavity (27B), and thus the base block 15 reciprocates to resist the spring force of the springs (15*k*, 15*k*). The width of the concavity in the direction which intersects perpendicularly with the revolving shaft of the rotating cylinder 4 in the concavity (27B) is at least twice the deflection amount of the deflection cam (15*g*). For this reason, the base block 15 does not move in the direction that intersects perpendicularly with the revolving shaft.

The springs (15*k*, 15*k*) absorb the inertia force in the extreme points of the reciprocating motion of the depilation block 24, and reduce the sound of the base block 15 making contact with the depilation block 24.

Hooks are provided on the undersurface of the base body (15*a*) and are made to connect with the hook connection 10 of the housing 1, thereby allowing the depilation head 2 to be attached on the housing 1. The depilation head 2 is fixed to the housing 1 by the both slide frames 26, 26 capable of moving outside due to the elastic force of the springs (26*d*, 26*d*) and hooking the support hooks (261*b*, 261*b*) on the hooks 11, 11. Thus, when the depilation head 2 is attached on the housing 1, a pinion section of the gear 19 meshes with the reduction gear (15*c*). When the controlling element (26*a*) is pushed, the support hook (261*b*) disengages from the hook 11, and thus the depilation head 2 is released from the housing 1.

Figure 15:
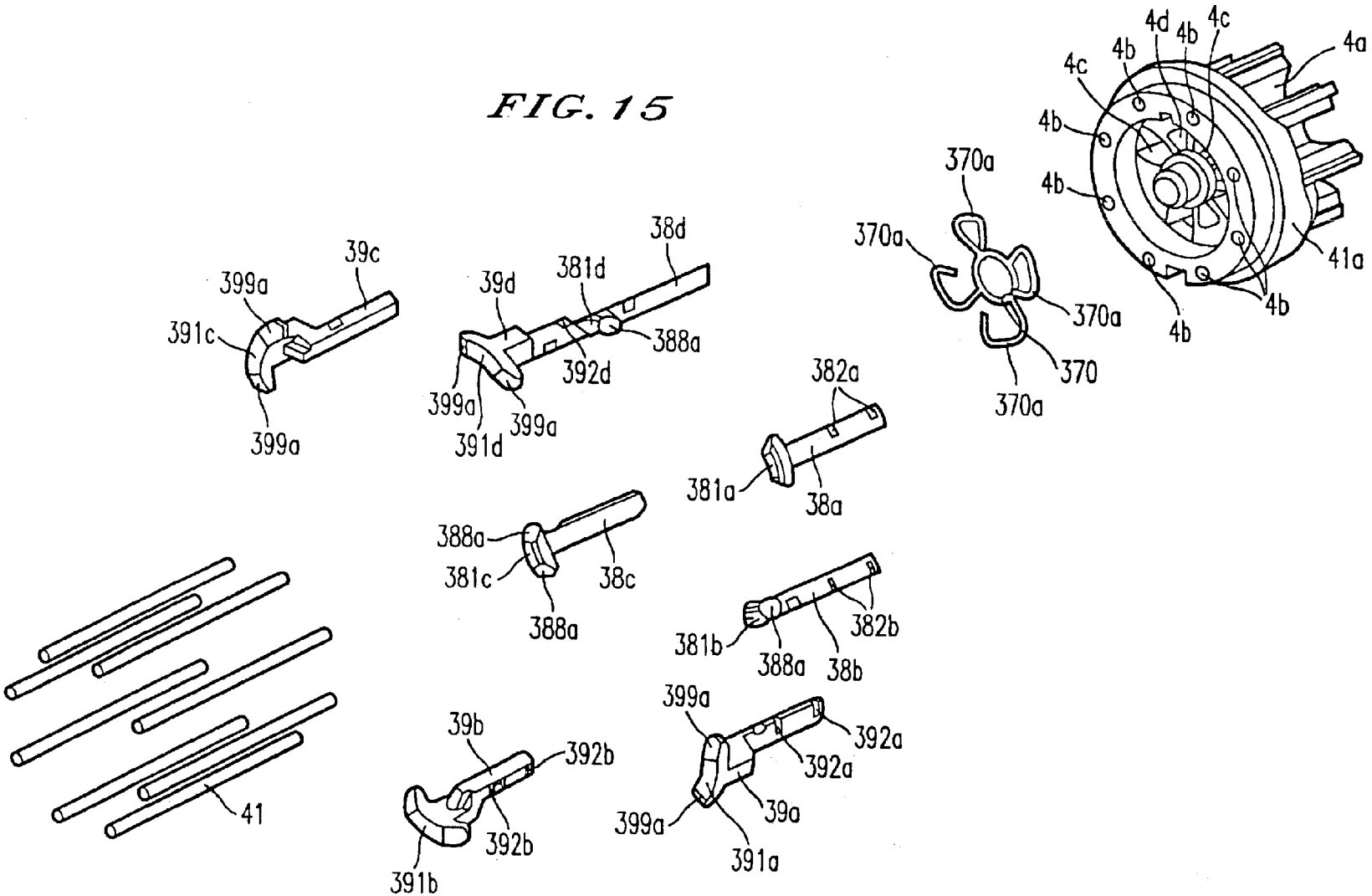
FIG. 15 is a disassembled perspective diagram of the rotating cylinder according to the first embodiment of the present invention.
Figure 16:
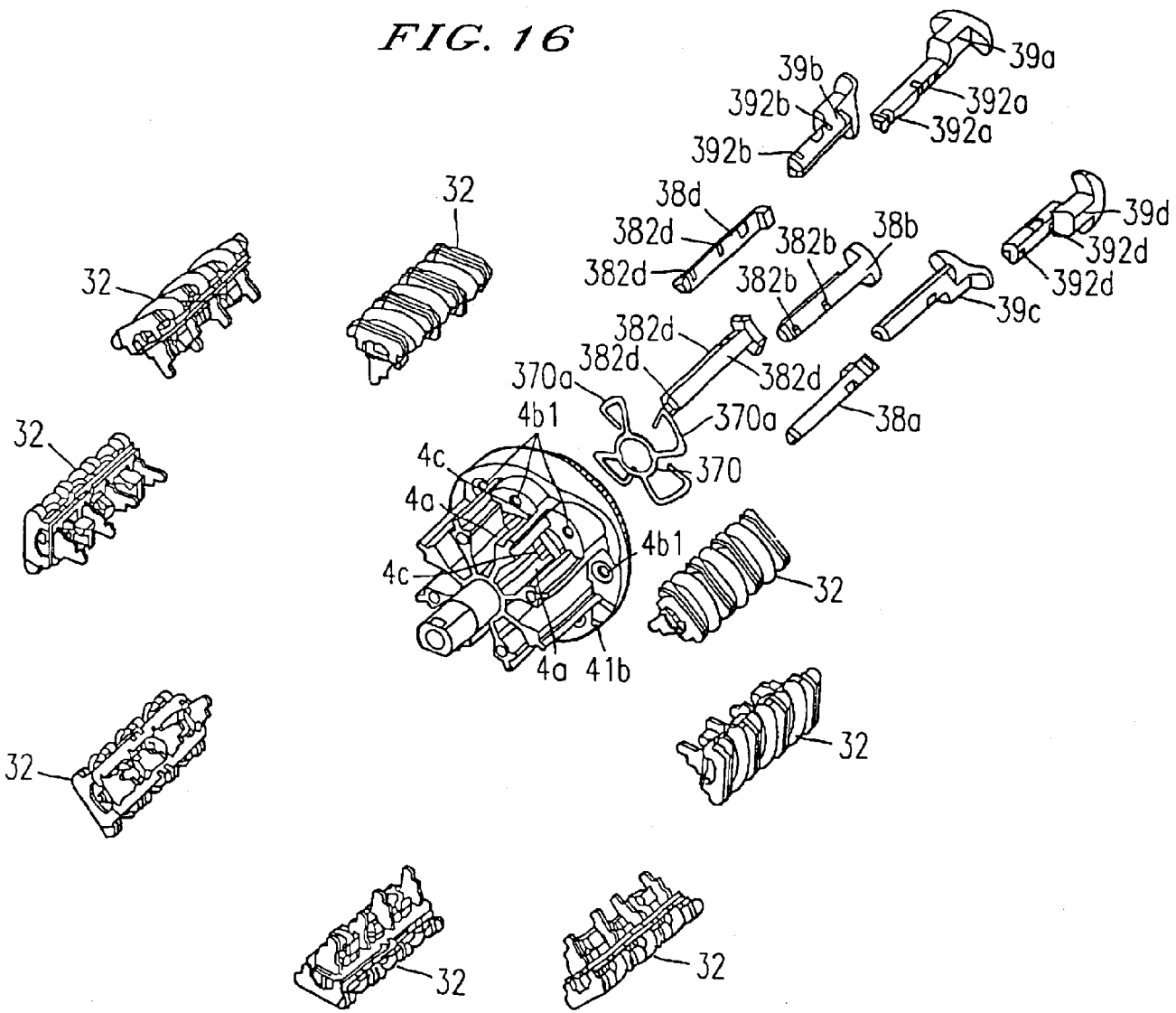
FIG. 16 is another disassembled perspective diagram of the rotating cylinder according to the first embodiment of the present invention.

Referring to FIGS. 15 and 16, the rotating cylinder 4 is formed by joining a couple of body components (41*a*, 41*b*) with shafts 41. Along the periphery of the rotating cylinder 4, concavities (4*a*) are formed on the hoop side of the rotating cylinder 4. The rotating cylinder 4 in FIG. 16 has eight concavities (4*a*) at intervals of 45 degrees. The concavities (4*a*) each have a depilation unit 32.

Figure 17:
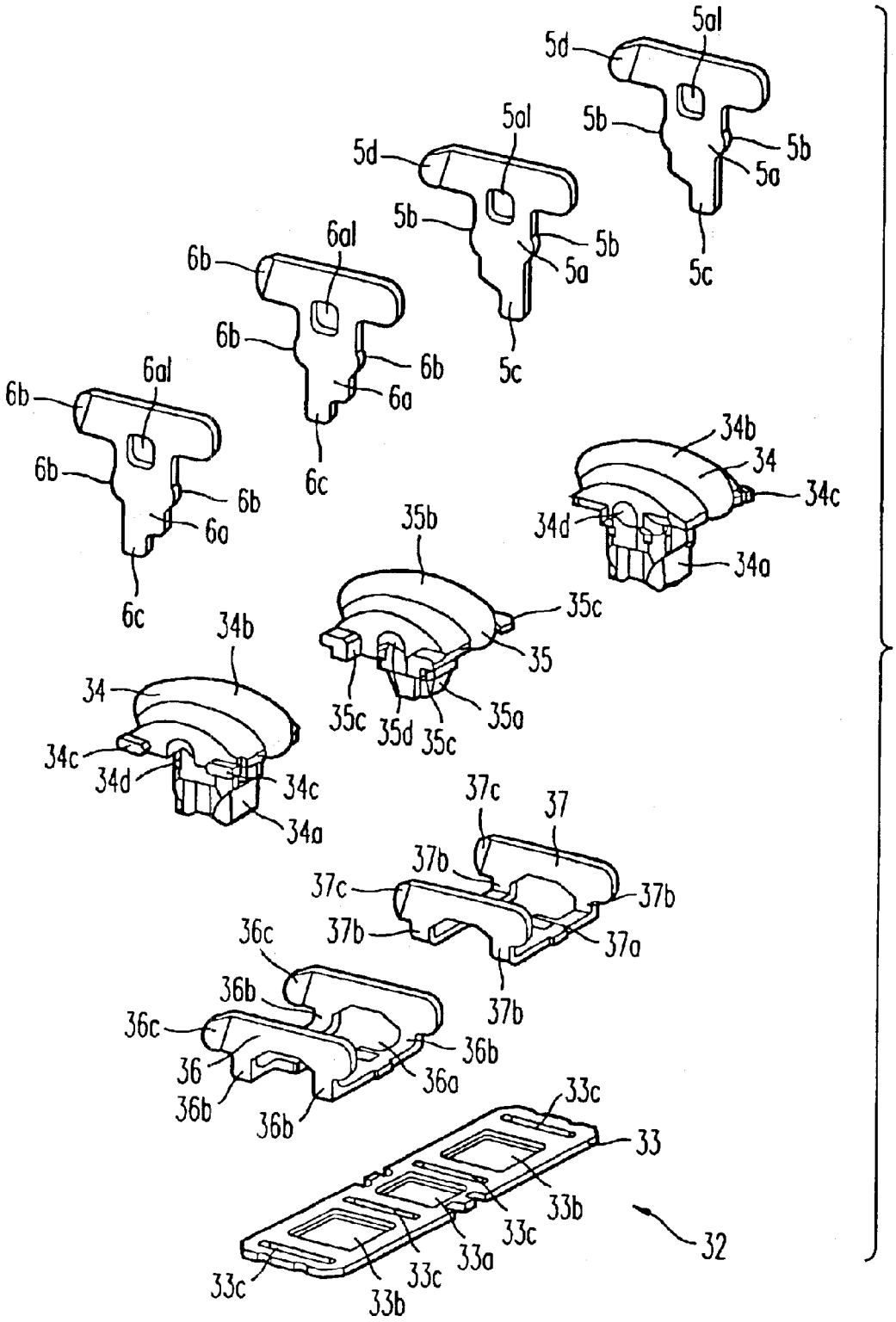
FIG. 17 is a disassembled perspective diagram of the subject unit for depilation according to the first embodiment of the present invention.

Referring to FIG. 17, the depilation unit 32 includes a fulcrum plate 33, two or more movable claws (5*a*, 6*a*) (FIG. 17 shows four movable claws), fulcrum stop members 34, 35, and fixed claws 36, 37. The fixed claws 36, 37 are provided in a pair so as to make the depilation unit 32 easily.

The fulcrum plate 33 includes rectangular holes (33*a*, 33*b*) in which the fulcrum stop members 34, 35 are inserted, and rectangular holes (33*c*) in which the movable claws (5*a*, 6*a*) are inserted. The projections (34*a*, 35*a*) provided on the undersurface of the fulcrum stop members 34, 35 are pressed fit and fixed to the rectangular holes (33*a*, 33*b*) of the fulcrum plate 33 through the holes (36*a*, 37*a*) provided on the fixed claws 36, 37. That is, the fulcrum stop members 34, 35 and the fixed claws 36, 37 are fixed simultaneously.

The projections (5*b*, 6*b*) at the ends of the movable claws (5*a*, 6*a*) engage with ribs (34*c*, 35*c*) provided at the ends of the fulcrum stop members 34, 35. Thereby, the movable claws (5*a*, 6*a*) are attached to the side of the fixed claws 36, 37. The movable claws (5*a*, 6*a*) are arranged in the holes (36*a*, 37*a*) of the fixed claws 36, 37 so that the movable claws (5*a*, 6*a*) are located on the same side as the fixed claws 36, 37.

The depilation unit 32 thus assembled as units are inserted in the concavities (4*a*) of the rotating cylinder 4, respectively. A shaft 41 inserted from the hole (4*b*) provided in one end of the concavity (4*a*) is inserted in the holes (4*b*1) of the rotating cylinder 4 through holes (34*d*, 35*d*) of the fulcrum stop member 34, 35, and holes (5*a*1, 6*a*1) of the movable claws (5*a*, 6*a*). Thereby, the depilation unit 32 is held in the concavity (4*a*).

Referred to FIG. 15, two or more holes (4*c*) are formed in one surface of the body component (41*a*) of the rotating cylinder 4, and opening-and-closing levers (38*a*, 38*b*, 38*c*, 38*d*) and opening-and-closing levers (39*a*, 39*b*, 39*c*, 39*d*) are inserted in holes (4*c*). Press sections (381*a*, 381*b*, 381*c*, 381*d*) are provided at the edges of the opening-and-closing levers (38*a*, 38*b*, 38*c*, 38*d*). Press sections (391*a*, 391*b*, 391*c*, 391*d*) are provided at the edges of the opening-and-closing levers (39*a*, 39*b*, 39*c*, 39*d*). The press sections (381*a*, 381*b*, 381*c*, 381*d*) are positioned more inside of the rotating cylinder 4 than the press sections (391*a*, 391*b*, 391*c*, 391*d*), and the edges of the press sections (391*a*, 391*b*, 391*c*, 391*d*) and press sections (381*a*, 381*b*, 381*c*, 381*d*) overlap each other. Referred to FIG. 16, two or more holes (4*c*) are formed in the other surface of the body component (41*b*) of the rotating cylinder 4, and the opening-and-closing levers (39*a*, 39*b*, 39*c*, 39*d*) and the opening-and-closing levers (38*a*, 38*b*, 38*c*, 38*d*) are inserted in the holes (4*c*).

Each opening-and-closing lever (38*a*, 38*b*, 38*c*, 38*d*, 39*a*, 39*b*, 39*c*, 39*d*) includes a slot (382*a*, 382*b*, 382*c*, 382*d*, 392*a*, 392*b*, 392*c*, 392*d*). When the slots (382*a*, 382*b*, 382*c*, 382*d*, 392*a*, 392*b*, 392*c*, 392*d*) are positioned in the concavities (4*a*) of the rotating cylinder 4 with the depilation unit 32, the slots engage with the protruding pieces (5*c*, 6*c*) of the movable claws (5*a*, 6*a*). The opening-and-closing levers inserted from the body component (41*a*) engage with the protruding piece (6*c*) of the movable claw (6*a*), and the opening-and-closing levers inserted from the body component (41*b*) engage with the protruding piece (5*c*) of the movable claw (5*a*).

Figure 18:
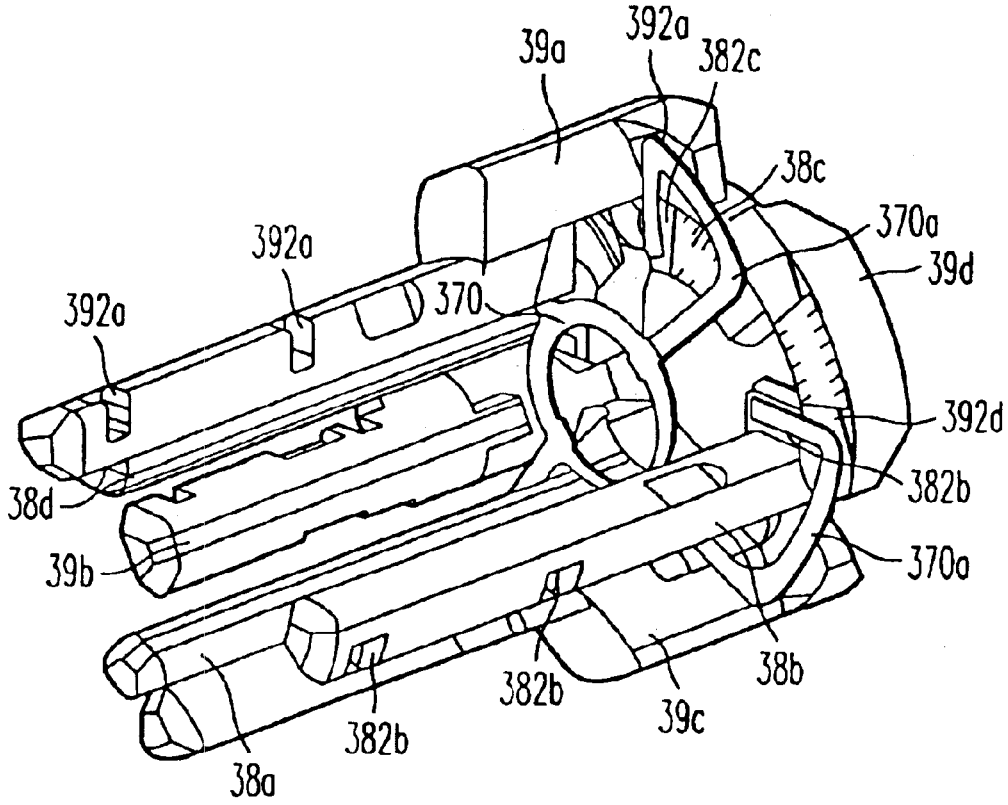
FIG. 18 is a perspective diagram showing the assembly state of opening-and-closing levers according to the first embodiment of the present invention.
Figure 19:
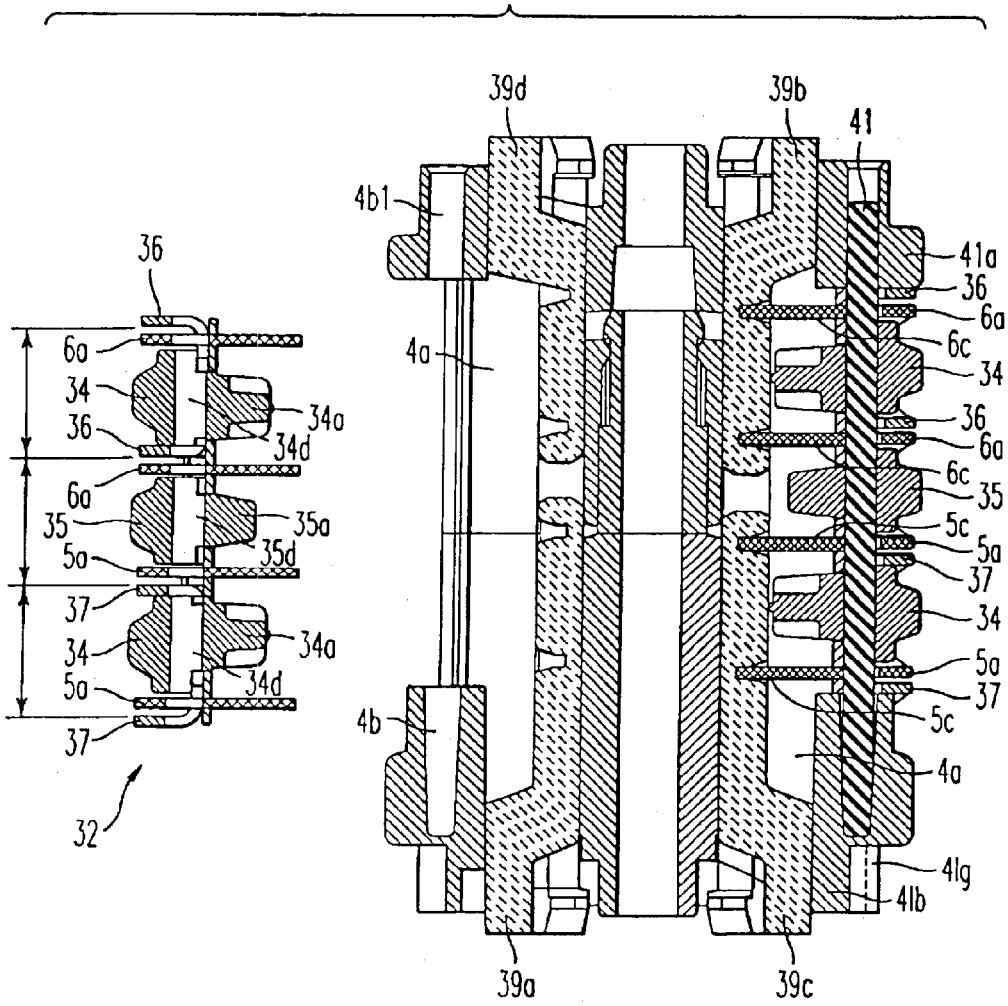
FIG. 19 is a disassembled sectional drawing of the rotating cylinder according to the first embodiment of the present invention.

Between both end surfaces of the rotating cylinder 4 and the press sections of the opening-and-closing levers (38*a*, 38*b*, 38*c*, 38*d*, 39*a*, 39*b*, 39*c*, 39*d*), a flat spring is arranged as a return spring 370. Referred to FIGS. 15, 16 and 18, the central part of the return spring 370 has a hole for positioning which engages with the projections (4*d*) provided in the central part of surfaces of the body components (41*a*, 41*b*). The return spring 370 includes four spring pieces (370*a*) in a U shape. The spring pieces (370*a*) urge the opening-and-closing levers (38*a*, 38*b*, 38*c*, 38*d*, 39*a*, 39*b*, 39*c*, 39*d*) in the axial direction of the rotating cylinder 4.

Because the spring pieces (380*a*) have a U shape to increase the effective length of the spring pieces, the spring force required to press the opening-and-closing levers by the cam 29 is made small. Therefore, the rotating cylinder 4 has a small load and high efficiency. The spring pieces (370*a*) have a spiral configuration extending from base to nose formed on the side of the opening-and-closing lever. For this reason, the amount of movement by the opening-and-closing levers is increased, and the amount of opening created between the fixed claws 36, 37 and the movable claws (5*a*, 6*a*) is enlarged.

One spring piece (370*a*) pushes two adjacent opening-and-closing levers (38*b*, 39*d*) toward outside, and another spring piece (370*a*) pushes other two adjacent opening-and-closing levers (38*c*, 39*a*) toward outside. Therefore, all the opening-and-closing levers (38*a*, 38*b*, 38*c*, 38*d*, 39*a*, 39*b*, 39*c*, 39*d*) are pushed toward outside by the return spring 370 that has four spring pieces (370*a*).

Since the grasping location of the depilation claws is provided in the rotational direction of the rotating cylinder 4 at equal intervals, the depilating device has good balance for extracting body hairs and is highly efficient in removing body hairs.

A pair of fixed claws 36, 37 perform opening-and-closing operation with the movable claws (5*a*, 6*a*) connected with a same opening-and-closing lever. The fixed claws 36, 37 have elastic sections (36*b*, 37*b*). As such, the grasping strength at the time of the movable claws (5*a*, 6*a*) being pressed by the fixed claws 36, 37 is not greatly influenced by their precision. In other words, if the grasping strength of some of the movable claw (6*a*) is strong, the fixed claw 36 elastically deforms in the press direction. Consequently, the depilating device removes body hairs efficiently and effectively. The fixed claws 36, 37 may be made of metal components with spring property for better performance. Since the depilation units 32 have shifted positions with respect to each other in the shaft direction, they remove body hairs in a wide range in one rotation. The fulcrum stop members 34, 35 include arced member (34*b*, 35*b*) in their top-faces to prevent the movable claws (5*a*, 6*a*) and fixed claws 36, 37 from making direct contact with skin, thereby protect the skin from being scraped by the movable and fixed claws.

In the embodiment above, the rotation of the motor 3 is transmitted to the reduction gear (15*c*) through the overload clutch 18 and the gear 19, the rotation of the reduction gear (15*c*) is then transmitted to the reduction gear (41*g*) through the gear 40, and subsequently the rotating cylinder 4 rotates.

Figure 6:
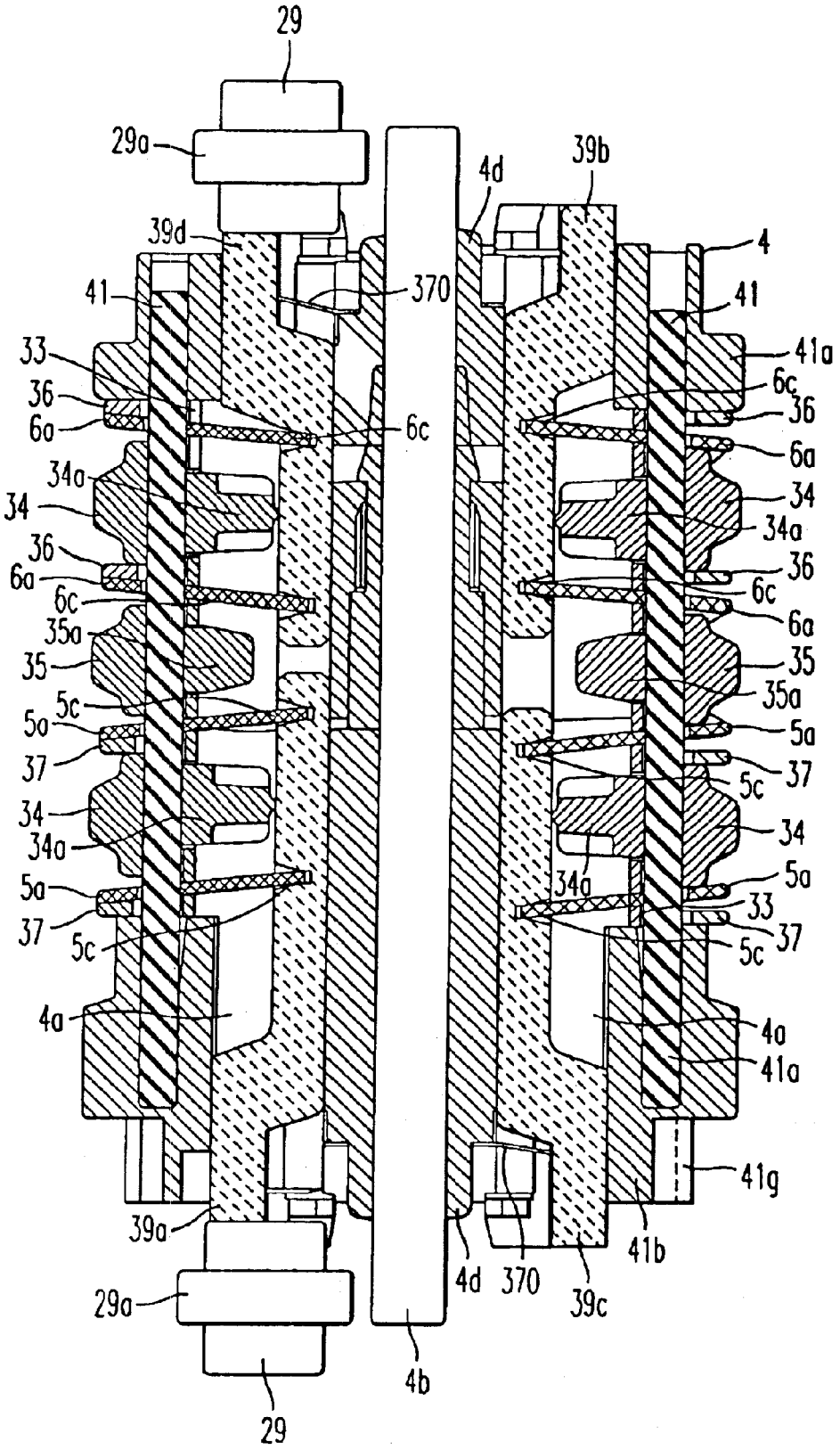
FIG. 6 is a sectional section of a rotating cylinder according to the first embodiment of the present invention.

As shown in FIG. 6, as the rotating cylinder 4 rotates, the opening-and-closing levers (38*a*, 38*b*, 38*c*, 38*d*, 39*a*, 39*b*, 39*c*, 39*d*) are pushed by the cam 29 toward inside against the return spring (370*a*) when the opening-and-closing levers (38*a*, 38*b*, 38*c*, 38*d*, 39*a*, 39*b*, 39*c*, 39*d*) reach the location of the cam 29. The opening-and-closing levers (38*a*, 38*b*, 38*c*, 38*d*, 39*a*, 39*b*, 39*c*, 39*d*) push the protruding pieces (5*c*, 6*c*) of the lower part of the movable claws (5*a*, 6*a*) toward inside.

As the four movable claws are pushed toward inside and rotate, they push and abut against the fixed claws. Hairs introduced between the movable claws (5*a*, 6*a*) and fixed claws 36, 37 are thus pinched, and pulled out because the rotating cylinder 4 rotates further away from where the hairs are pinched. The following opening-and-closing lever moves into the position of the cam 29 by rotation of the rotating cylinder 4, and is pressed by the cam 29, thus more hairs are pinched and pulled out.

Figure 14:
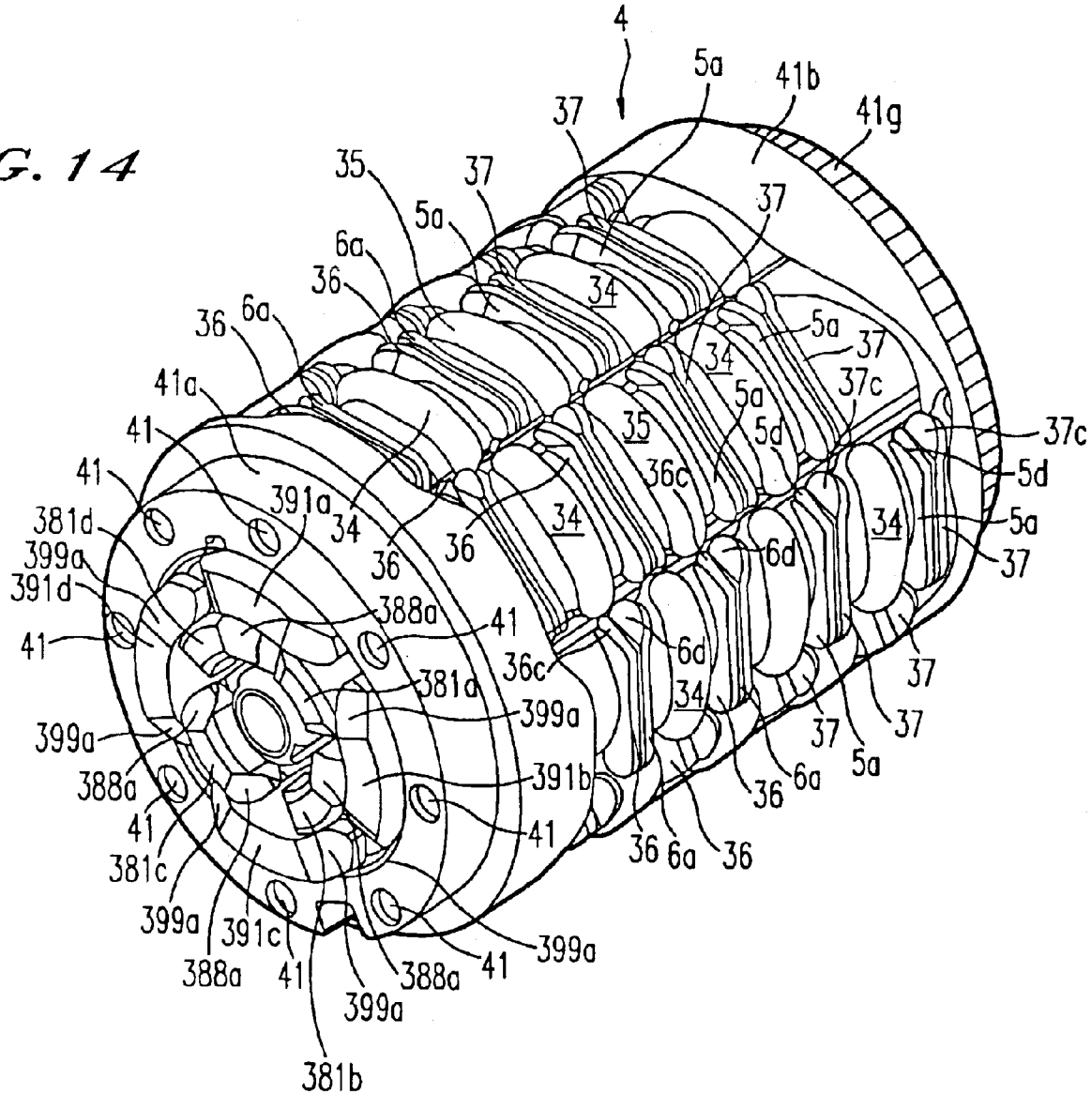
FIG. 14 is a perspective diagram of the rotating cylinder according to the first embodiment of the present invention.
Figure 20:
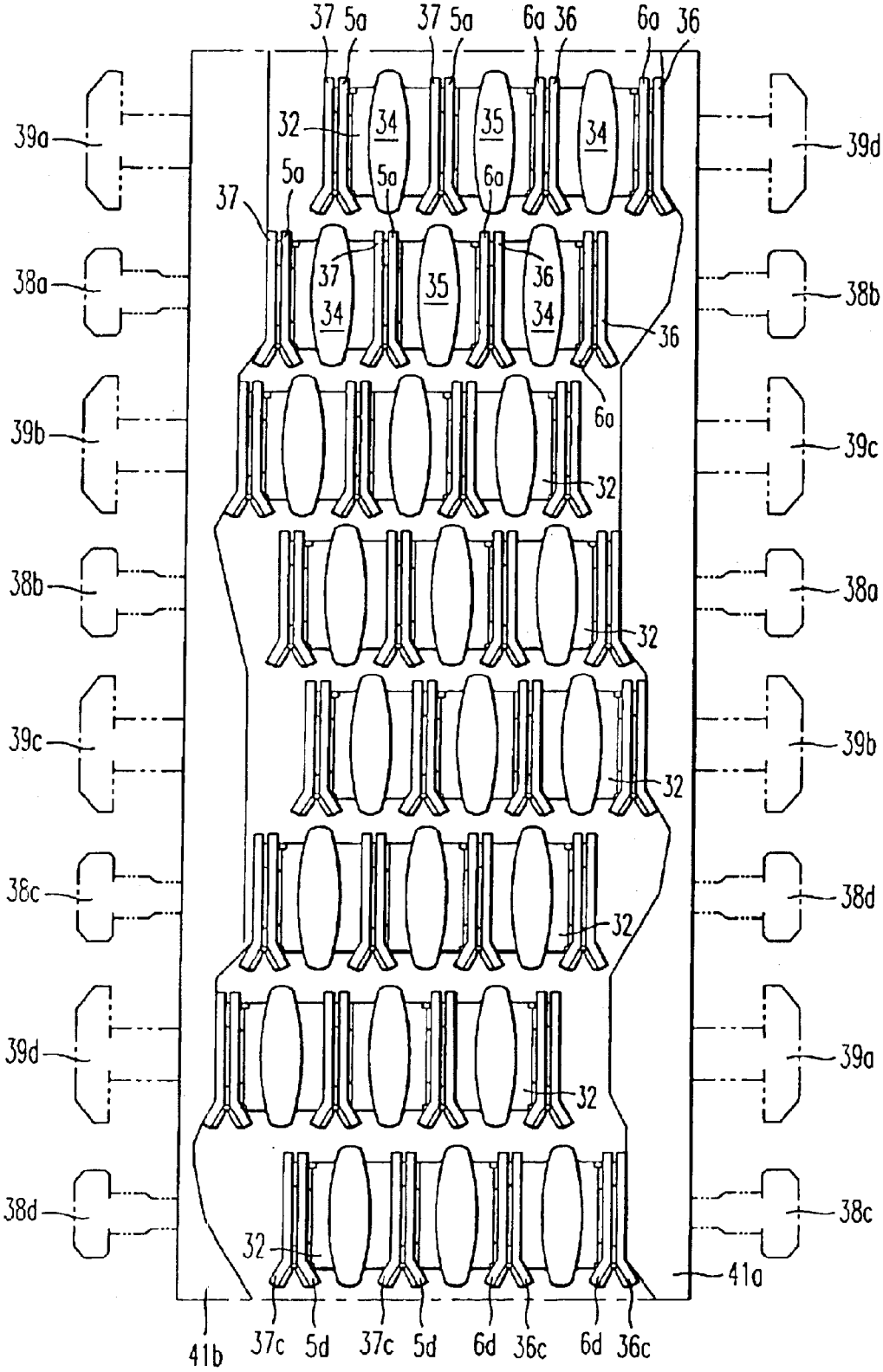
FIG. 20 is a surface development view of the rotating cylinder according to a first embodiment of the present invention.
Figure 21:
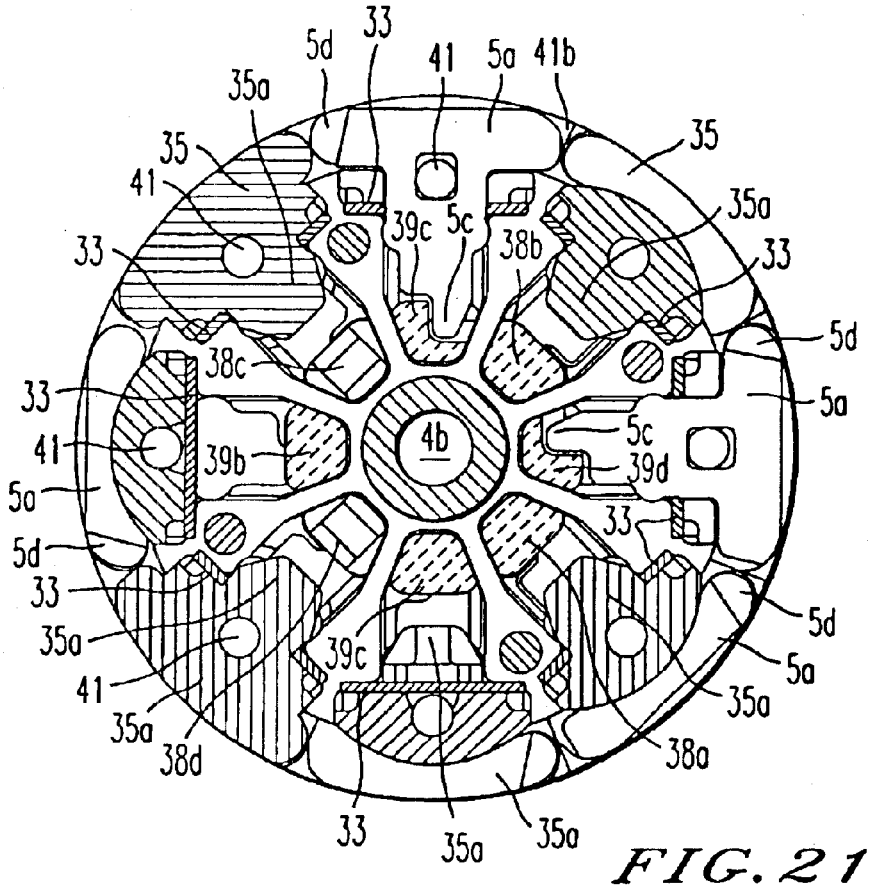
FIG. 21 is a cross-sectional view of the rotating cylinder according to a first embodiment of the present invention.

As shown in FIGS. 14, 17 and 20, edge portions (36*c*, 37*c*) of the fixed claws 36, 37 are bent toward outside in the shaft direction and are symmetrically bent for the edge portions (36*c*, 37*c*) of the movable claws (5*a*, 6*a*). Therefore, it makes easy to introduce long hairs to the pinching section.

Figure 22:
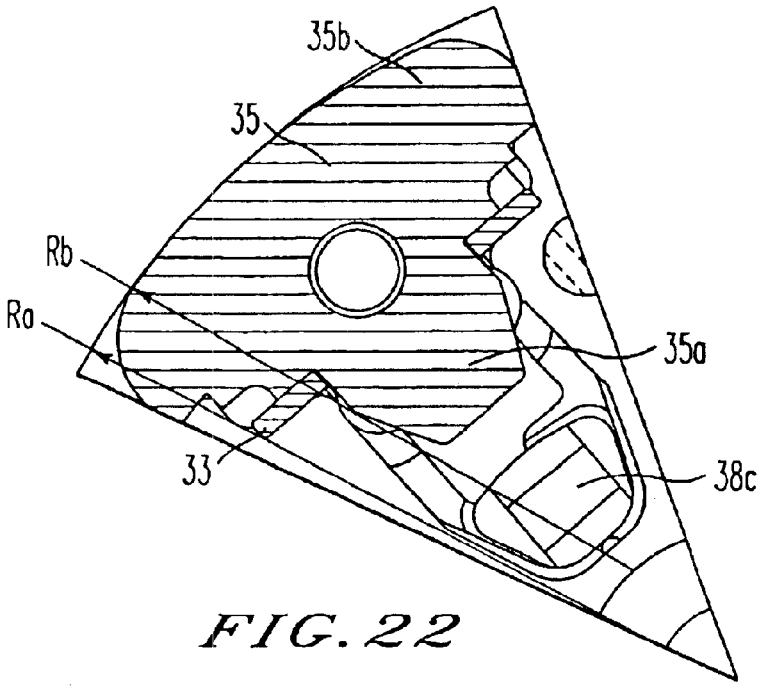
FIG. 22 is a partial enlarged view of a rotating cylinder according to another embodiment of the present invention.
Figure 23:
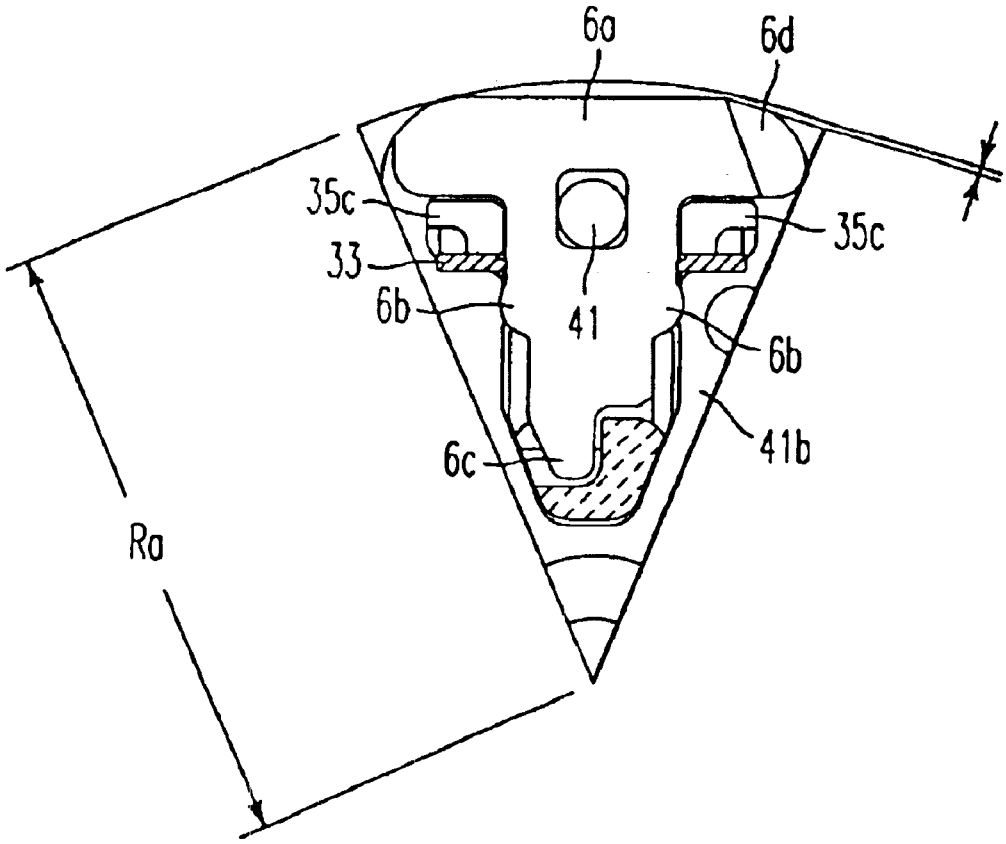
FIG. 23 is another partial enlarged view of the rotating cylinder according to another embodiment of the present invention.

As shown in FIG. 23, edge portions (5*d*, 6*d*) of the movable claws (5*a*, 6*a*) and the edge portions (36*c*, 37*c*) of the fixed claws 36, 37 are made smaller than the radius of gyration (Ra) of the rotating cylinder 4, thereby protecting the skin from being scraped by the edge portions (5*d*, 6*d*, 36*c*, 37*c*). As shown in FIG. 22, the arced sections (34*b*, 35*b*) for skin protection also have radii (Rb) which are smaller than the radius of gyration (Ra) of the rotating cylinder 4. Thereby, frictional resistance of the skin against the rotating cylinder 4 is made small.

As shown in FIG. 14, the both ends of the press sections (381*a*, 381*b*, 381*c*, 381*d*) are overlapped with the edges of the press sections in the radical direction. While the cam 29 is pressing the back end section of the opening-and-closing lever causing to pinch hairs, the front end section of the following opening-and-closing lever is simultaneously pressed by the cam 29. For this reason, in spite of arranging two or more claws (5*a*, 6*a*, 36, 37) in the periphery of the rotating cylinder 4, the distance in which hairs is pinched and pulled out is long.

The ends of press sections (381*a*, 381*b*, 381*c*, 381*d*) and press sections (391*a*, 391*b*, 391*c*, 391*d*) have slanted faces (388*a*, 399*a*), which are slanted in a cross direction from each other. For this reason, fluctuation of load is suppressed and the noise caused by rotation of the rotating cylinder 4 is also suppressed.

While rotating the rotating cylinder 4 and removing hairs, rotation is transmitted also to the gear (15*e*) from the reduction gear (15*c*), and thus the eccentric cam (15*g*) rotates. By this rotation, the depilation block 24 reciprocates periodically in the axial direction of the rotating cylinder 4 on the base block 15. As such, the pinching location of the fixed and movable claws in the rotating cylinder 4 shifts and hairs in a large range is removed at once.

Since the overload clutch 18 is in the housing 1, the torque required to be transmitted by the overload clutch 18 is small. Also, it is not necessary to have a strong spring force for the clutch spring 182. The stop section (181*b*) also requires less strength. The cost of the overload clutch 18 is therefore reduced.

The reduction gear 19 has the gear-wheel section and the pinion section. Although the rotation is received through the pinion of the reduction gear 19 in the depilation head 2, the gear wheel of the reduction gear 19 may receive the rotation. By using these options selectively, different clutch torques for various depilation heads are made available.

Figure 24A:
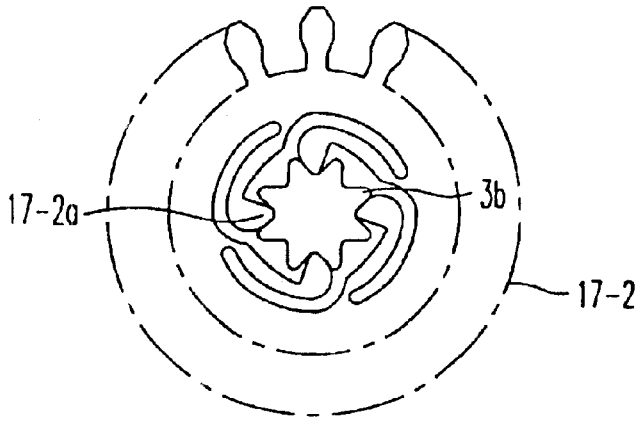
FIG. 24(*a*) is a plane view of an overload clutch according to another embodiment of the present invention.
Figure 24B:
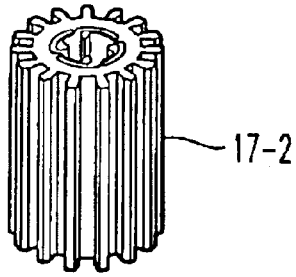
Figure 24C:
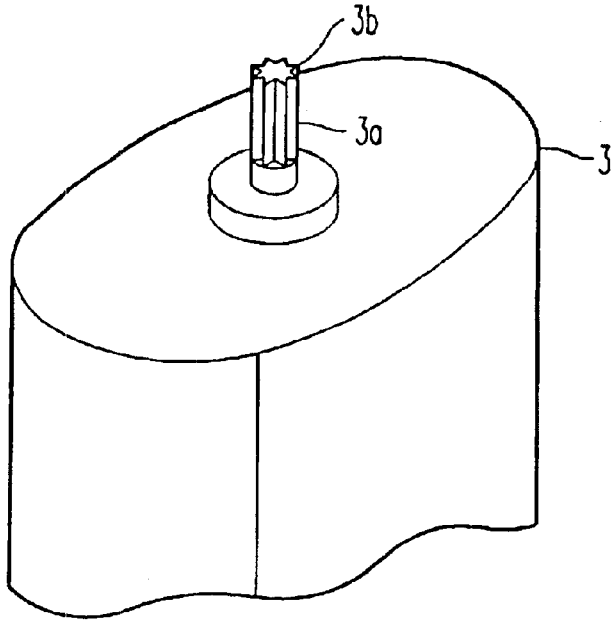

Another embodiment is shown in FIG. 24. The overload clutch may be provided on the place of the output shaft of the motor 3. A knurling tool (3*b*) is provided on the output shaft (3*a*) of the motor 3. Two or more clicks (17-2*a*) are provided in an inner surface of a pinion (17-2) with which the periphery of the output shaft (3*a*) is equipped. Rotation is transmitted to the pinion (17-2) from the motor 3 because clicks gear with the knurling tool (3*b*).

When the clicks (17-2*a*) are bent during the overload state, only the output shaft (3*a*) rotates, and thus the rotation is not transmitted to the pinion (17-2).

Since the overload clutch which interrupts power transfer at the time of overload is provided between the drive unit and drive transmission means which transmit sufficiently high torque to the depilation head side in the housing, the torque transmitted via the overload clutch is made small. Therefore, the strength of the overload clutch components can be made less than that of the conventional equipment, and thus the manufacturing cost of the overload clutch can be lowered. Moreover, since the torque required to be transmitted is small, there is less deformation of the components and less wear of the overload clutch components, thereby offering excellent durability. Also, since it is not necessary to provide the overload clutch in the depilation head, the head is made smaller and thus making it more user-friendly. Furthermore, in a depilating device designed to detach and attach two or more heads selectively to the housing, since it is not necessary to make an overload clutch build in each head, the overall manufacturing cost can be lowered significantly.

Figure 25:
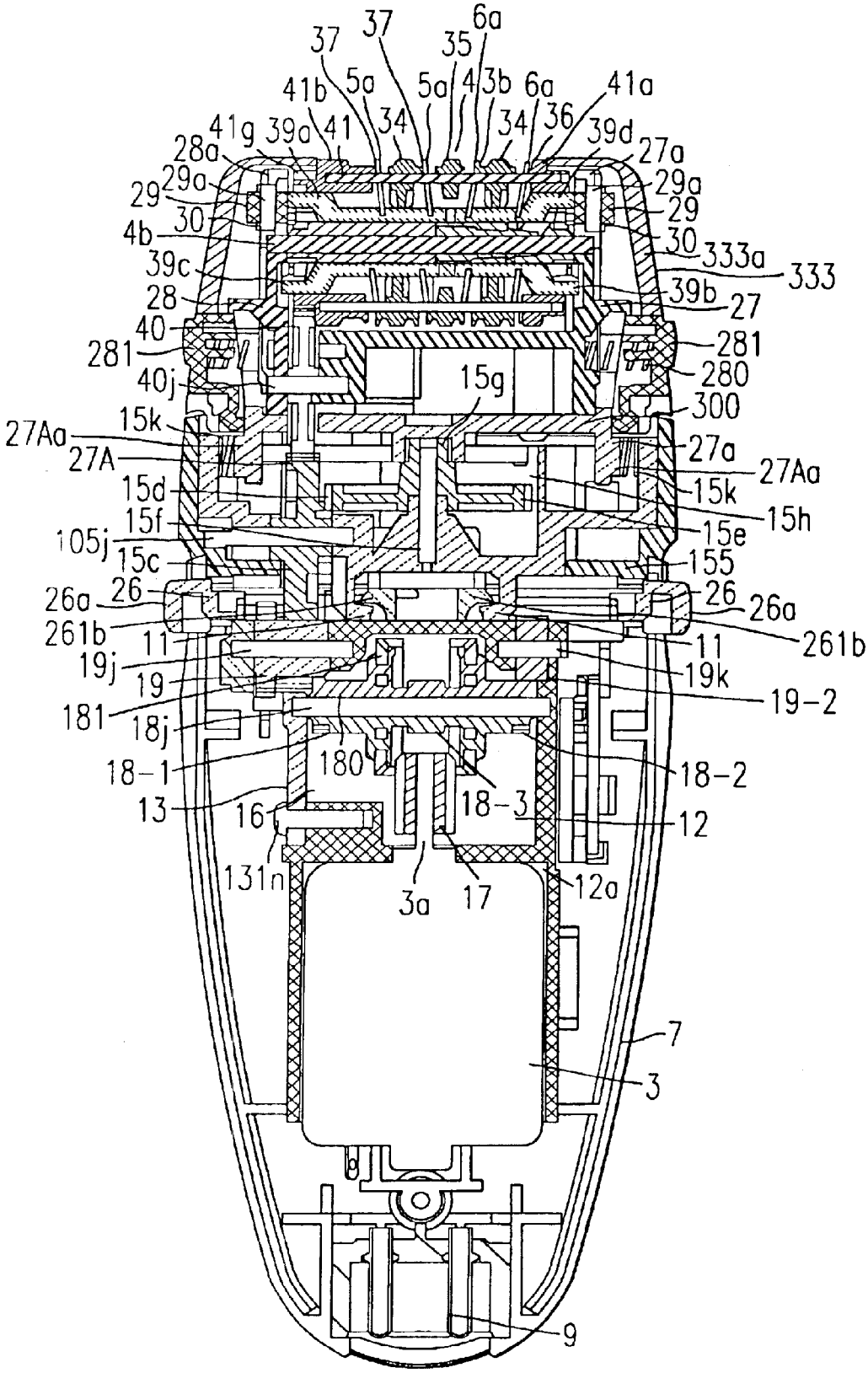
FIG. 25 is a longitudinal section of a depilating device according to another embodiment of the present invention.
Figure 26:
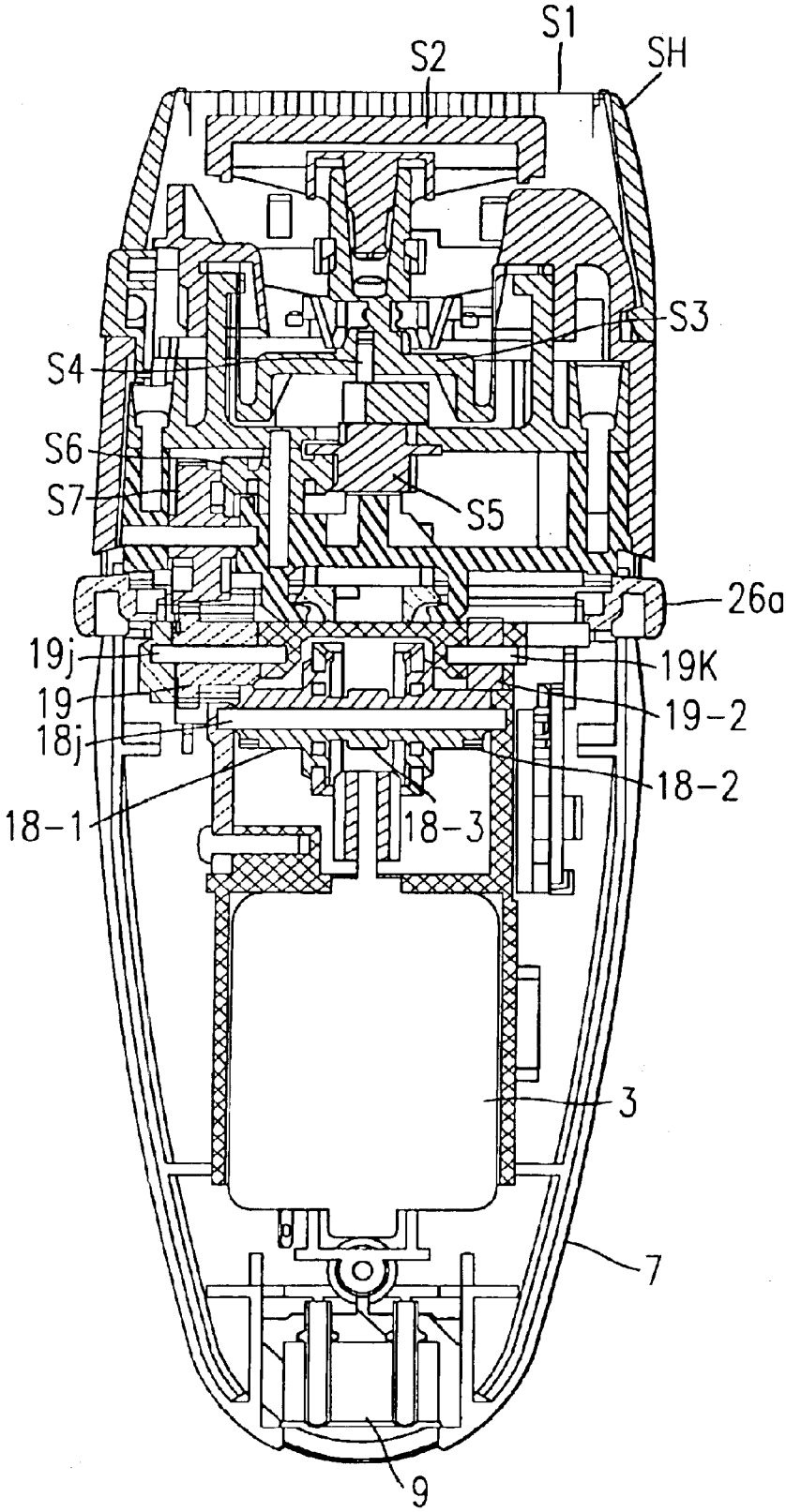
FIG. 26 is a longitudinal section of a depilating device according to another embodiment of the present invention.
Figure 27:
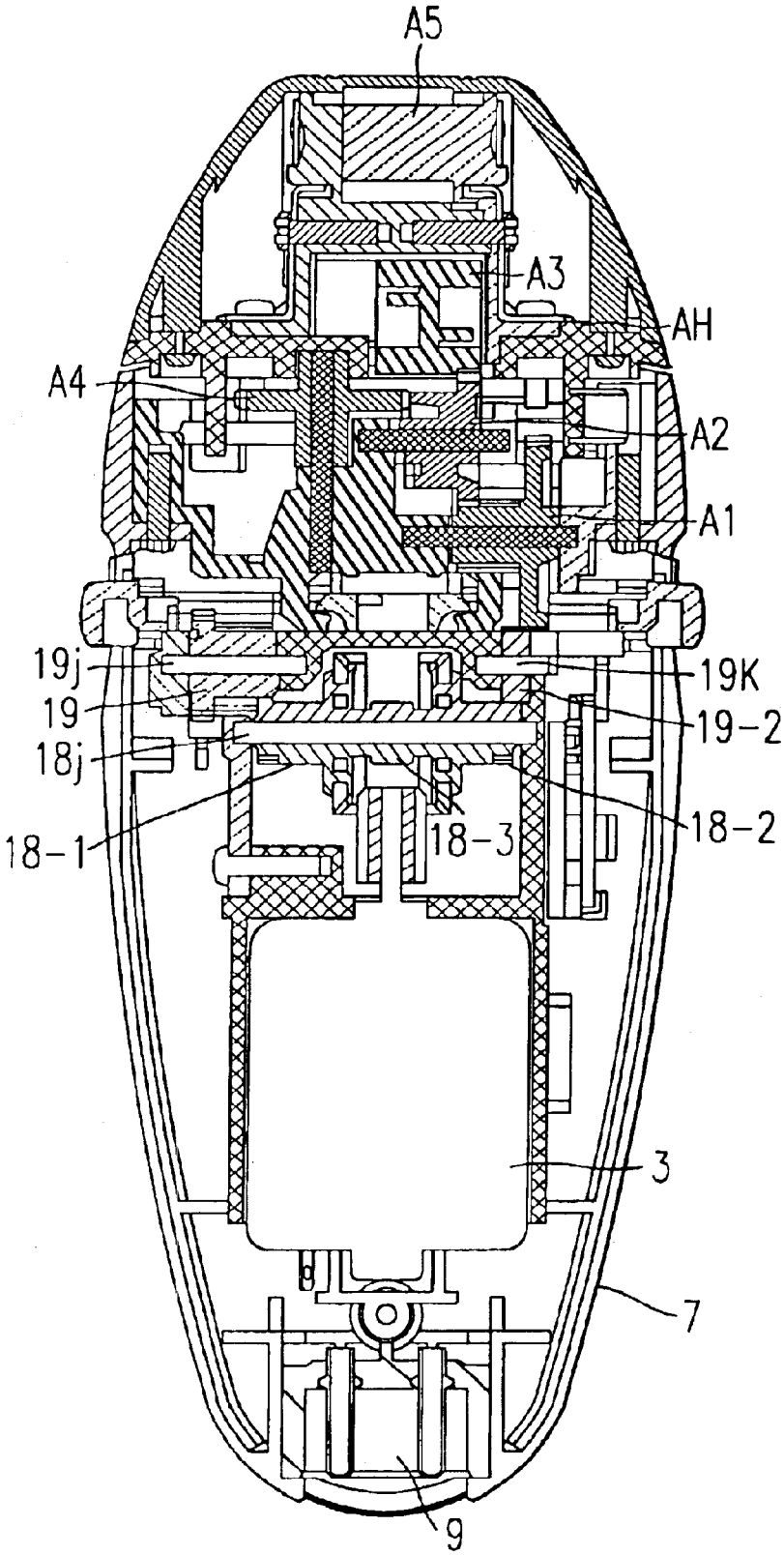
FIG. 27 is a longitudinal section of a depilating device according to another embodiment of the present invention.

Yet another embodiment is shown in FIGS. 25, 26 and 27. In this embodiment, a depilating device has two overload clutches (18-1, 18-2) which mesh with the pinion 17 provided in the output-shaft (3*a*) of the motor 3, the overload clutch (18-1) transmits power to the depilation head 2 through the reduction gear 19, and the overload clutch (18-2) transmits power to the depilation head 2 through a reduction gear (19-2). Each overload clutch (18-1, 18-2) has the same composition as the overload clutch 18 of the embodiment mentioned above. The depilating device has a separator (18-3). As shown in FIG. 25, the depilating device allows to transmit power selectively through the pinion of the reduction gear 19, the gear-wheel section of the reduction gear 19, or the reduction gear (19-2).

According to this embodiment, the depilating device can set up operation loads for various depilation heads without providing a different overload clutch for each depilation head, since the operation load of the overload clutch is changed selectively.

FIG. 26 shows the housing 1 equipped with a shaver head (SH). The rotation transmitted to the reduction gear 19 from the overload clutch (18-1) is transmitted to a rotor (S5) through a reduction gear (S6) from a reduction gear (S7) that meshes with the gear-wheel section of the reduction gear 19. An eccentric shaft (S4) provided in the rotor (S5) is supported by a mechanical component (S3) such that the eccentric shaft (S4) reciprocates freely, and thus an inner blade block (S2) in contact with the inside of an outer blade (S1) reciprocates.

Moreover, FIG. 27 shows the housing 1 equipped with a depilation head (AH). According to this embodiment, a reduction gear (19-2) supported by a shaft (19*k*) meshes with a reduction gear (A1), and rotation of a reduction gear (A1) is transmitted through a reduction gear (A2, A3, A4).

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A depilating device comprising:

a housing;

a depilation head detachably attached to the housing and including a hair removing device configured to remove hairs;

a driving unit provided in the housing and configured to drive the hair removing device; and at least one overload clutch provided in the housing to transmit driving output by the driving unit to the hair removing device and configured to interrupt transmission of the driving when a torque required to operate the hair removing device is beyond a predetermined value.

2. A depilating device according to claim 1, wherein the hair removing device includes a rotating cylinder configured to rotate and remove hairs.

3. A depilating device according to claim 2, wherein the rotating cylinder includes at least one pair of claws configured to grab hairs.

4. A depilating device according to claim 3, wherein the at least one pair of claws comprises a plurality of pairs of claws configured to grab hairs.

5. A depilating device according to claim 4, wherein the plurality of pairs of claws are arranged at equal intervals.

6. A depilating device according to claim 2, wherein the rotating cylinder reciprocates in an axial direction of the rotating cylinder.

7. A depilating device according to claim 2, wherein:

the driving unit comprises a motor; and the motor includes an output shaft positioned perpendicularly to an axial direction of the rotating cylinder.

8. A depilating device according to claim 1, wherein the at least one overload clutch is configured to restore the transmission of the driving automatically when the torque required to operate the hair removing device is no longer beyond the predetermined value.

9. A depilating device according to claim 1, wherein the driving unit comprises a motor.

10. A depilating device according to claim 9, wherein the at least one overload clutch is provided in an output shaft of the motor.

11. A depilating device according to claim 1, wherein the at least one overload clutch comprises a reduction gear configured to transmit the driving.

12. A depilating device according to claim 11, wherein the reduction gear is positioned adjacent to the driving unit.

13. A depilating device according to claim 11, wherein the driving unit is configured to output the driving in different modes according to breadth of skin contacted by the rotating cylinder.

14. A depilating device according to claim 1, wherein the at least one overload clutch is configured to change a load of operation.

15. A depilating device according to claim 14, wherein the at least one overload clutch is configured to change the load of operation according to the depilation head attached to the housing.

16. A depilating device according to claim 1, wherein the driving unit is configured to output the driving in different modes.

17. A depilating device according to claim 1, wherein the at least one overload clutch comprises a plurality of overload clutches each configured to interrupt the transmission of the driving and each having a different load of operation.

18. A depilating device according to claim 1, wherein the at least one overload clutch is configured to interrupt the transmission of the driving before the driving unit is overloaded.

19. A depilating device comprising:

a housing;

depilation means for depilating hairs, the depilating means being detachably attached to the housing;

driving means for outputting driving for the depilation means, the driving means being disposed in the housing; and clutch means for interrupting transmission of driving output by the driving means when a torque required to operate the depilation means is beyond a predetermined value, the clutch means being provided in the housing to transmit the driving output by the driving means to the depilation means.

20. A depilating device comprising:

a housing;

a plurality of depilation heads each configured to attach to the housing and each including a hair removing device configured to remove hairs, the plurality of depilation heads being selectively attached to the housing according to hairs to be removed;

a driving unit provided in the housing and configured to drive the hair removing device; and at least one overload clutch provided in the housing to transmit driving output by the driving unit to the hair removing device and configured to interrupt transmission of the driving when a torque required to operate the hair removing device is beyond a predetermined value.

* * * * *

UNITED STATES PATENT AND TRADEMARK OFFICE

CERTIFICATE OF CORRECTION

PATENT NO. : 6,730,100 B2
DATED : May 4, 2004
INVENTOR(S) : Naoki Yamaguchi et al.

It is certified that error appears in the above-identified patent and that said Letters Patent is hereby corrected as shown below:

Column 8,
Line 27, please change “rotating cylinder 4” to -- rotating cylinder 4 toward outside --.

Signed and Sealed this

Ninth Day of November, 2004

JON W. DUDAS
*Director of the United States Patent and Trademark Office*